US006182345B1

(12) United States Patent
Travis

(10) Patent No.: US 6,182,345 B1
(45) Date of Patent: Feb. 6, 2001

(54) GRIPPING JAW ASSEMBLY WITH IN PHASE JAWS

(75) Inventor: Robert D. Travis, Tucson, AZ (US)

(73) Assignee: Huck International, Inc., Tucson, AZ (US)

( * ) Notice: Under 35 U.S.C. 154(b), the term of this patent shall be extended for 0 days.

(21) Appl. No.: 09/315,333

(22) Filed: May 20, 1999

(51) Int. Cl.[7] ..... B21J 15/00
(52) U.S. Cl. ..... 29/243.521; 72/391.2
(58) Field of Search ..... 29/243.521, 243.523, 29/243.522; 72/391.2, 391.4

(56) References Cited

U.S. PATENT DOCUMENTS

| | | | | |
|---|---|---|---|---|
| 2,053,718 | | 8/1936 | Huck et al. . | |
| 2,053,719 | | 8/1936 | Huck et al. . | |
| 2,531,048 | | 11/1950 | Huck . | |
| 3,107,806 | | 10/1963 | Van Hecke et al. . | |
| 3,157,305 | * | 11/1964 | Baugh | 29/243.521 |
| 3,693,399 | | 9/1972 | Chirco . | |
| 3,722,329 | | 3/1973 | Van Hecke et al. . | |
| 3,792,645 | | 2/1974 | Chirco et al. . | |
| 4,347,728 | | 9/1982 | Smith . | |
| 4,432,679 | | 2/1984 | Angelosanto et al. . | |
| 4,472,096 | | 9/1984 | Ruhl et al. . | |
| 4,587,829 | | 5/1986 | Sukharevsky . | |
| 4,597,263 | | 7/1986 | Corbett . | |
| 4,598,572 | | 7/1986 | Mondello et al. . | |
| 4,648,259 | * | 3/1987 | Pendleton | 29/243.521 |
| 4,708,552 | | 11/1987 | Bustos et al. . | |
| 4,878,372 | | 11/1989 | Port et al. . | |
| 5,519,926 | | 5/1996 | Rosier . | |

* cited by examiner

*Primary Examiner*—David Jones
(74) *Attorney, Agent, or Firm*—Harness, Dickey & Pierce P.L.C.

(57) ABSTRACT

A gripping jaw assembly for a pull tool for setting pull type fasteners of a type which include a pin and collar and/or sleeve with the pin having a pull portion adapted to be gripped by a plurality of jaws in the jaw assembly with the jaws having a plurality of gripping teeth and with the jaws being movable in separate guide tracks and also supported in a manner whereby the jaws and their gripping teeth are maintained axially and radially in phase with each other and with the pull portion of the pin and with the jaw teeth of the separate jaws being maintained in phase with each other when gripping the pull portion of the pin.

25 Claims, 11 Drawing Sheets

X
A
1
2
10
12
14
15
16
17
18
19
20
21
22
23
24
25
26
27
28
29
30
31
37
40
42
44
45
46
62
63
65
67
68
70'
72
76
78
85
86
87
88
91

GRIPPING JAW ASSEMBLY WITH IN PHASE JAWS

SUMMARY BACKGROUND OF THE INVENTION

The present invention relates to installation tools for setting pull type fasteners of a type which include a pin and collar and/or sleeve installed by the application of a relative axial force applied between the pin and collar and/or sleeve. In such fasteners the pin member typically has a pin portion with a plurality of pull grooves for being gripped by the installation tool whereby the relative axial force can be applied. Frequently the pin portion is severable and removed after installation and is referred to as a pintail or pintail portion. More particularly the installation tool includes a nose assembly having a jaw assembly or structure with a plurality of gripping jaws with teeth for gripping the pull grooves to apply such axial force.

Numerous types of multi-pieced fasteners are installed by the application of a relative axial force. Such fasteners can include a pin and sleeve and/or collar, and be of types such as those shown in the U.S. Pat. No. 2,531,048 issued Nov. 21, 1950, U.S. Pat. No. 4,432,679 issued Feb. 21, 1984 and U.S. Pat. No. 4,472,096 issued Sep. 18, 1984. Such fasteners have a pin with a pintail portion with pull grooves and have been installed by a pull tool having a nose assembly with a plurality of movable chuck jaws. Examples of such nose assemblies are noted in the '048 patent (supra) and the details of such are exemplified in the U.S. Pat. No. 3,107,806 issued Oct. 22, 1963. The chuck jaws have teeth adapted to mate with and grip the pull grooves on the fastener pin.

With such jaw assemblies it is possible under certain conditions, such as initial pin insertion between the jaws, for the jaws to move out of axial alignment with each other. When such misalignment occurs and the tool is actuated, the pull grooves on the pin can be gripped by less than the full complement or engagement of teeth on one or more of the jaws which can lead to malfunctions such as stripping of the pull grooves, jamming of the pintail, excessive wear or stripping of the jaw teeth, and/or ultimate failure of one or more jaws.

One solution to such problems was to provide a structure in which the jaws, conventionally constructed of hardened steel, are secured to an elastomeric support or jaw follower structure such that the jaws are generally axially fixed relative to each other whereby relative movement and axial misalignment is substantially precluded. This is shown in the U.S. Pat. No. 4,347,728 issued on Sep. 7, 1982. However, here the jaws are radially fixed at one end and thus could still be articulated radially somewhat non-uniformly and out of phase and circumferentially relative to each other. That structure did provide an improvement; however, when one of the jaws eventually failed or became detached from the elastomeric support structure, the entire jaw assembly had to be replaced. Subsequently an improvement was made on that type of structure in U.S. Pat. No. 4,598,572 which provided the advantages of the prior structure of the '728 patent, supra, but had the jaws removably secured to an elastomeric structure which permitted replacement and facilitated assembly of individual jaw members. Even here, however, some of the typical gripper jaw nose assembly problems remained since the jaws could articulate separately and the pull portion or pintail of the pin could still be moved off-center upon initial insertion between the jaws creating uneven gaps between jaws. Thus with this type of support structure the jaws could still get out of phase with each other and become unevenly supported when engaged with the pull grooves on the pin.

The present invention provides an improvement in both the support and alignment of the jaws. As such the present design maintains the jaws axially, radially and circumferentially synchronized or in phase, inhibiting out of phase conditions which could result in misalignment of jaw teeth. An additional benefit is that there essentially are no open gaps between jaws prior to pin insertion and hence, no opportunity for the pull portion or pintail upon initial insertion to create uneven gaps between jaws which could result in misalignment.

Thus in the present invention the jaw assembly or structure includes a configuration somewhat like that of the well known drill chucks sometimes referred to as JACOBS® chucks. As such in the present invention, the jaws are configured to be mounted matingly in radially angled or inclined cylindrical tracks or guide slots. However, similar track or hole guided jaw structures are not new and have been used in fastener installation tools. See U.S. Pat. No. 2,053,718 and U.S. Pat. No. 2,053,719 both issued Sep. 8, 1936. In the present invention, however, unique means are provided by which the jaws are axially supported and guided and circumferentially restricted to be synchronized or in phase with each other. In addition a jaw follower with a jaw retainer in the form of an elastomeric support structure is used that also serves as a shock attenuation member. Thus in the present invention, the combination of the use of guide tracks which are shaped to restrict and control relative circumferential and radial movement between the jaws and a jaw follower with an elastomeric jaw retainer which maintains axial alignment while permitting desired articulation results in an improved jaw structure.

It is common for a manufacturing facility to assemble workpieces utilizing fasteners of essentially the same type but of different diameters. Such fasteners can be installed with a single installation tool. However, the nose assembly may have to be changed to provide jaws compatible with the different diameters especially where a pintail portion with pull grooves is being gripped. In this regard it is not uncommon for pins of different diameters to have pull grooves of different pitches. In the present invention, an alternate jaw structure is shown in which a single nose assembly can be utilized to install similar fasteners of two different diameters with pull grooves of different pitches.

Some pull type fasteners are of the type in which the pin portion to be gripped is smooth such as shown in U.S. Pat. No. 4,708,553, issued Nov. 24, 1987. The present invention can be effectively utilized with such fasteners and in such cases the jaw teeth can be provided to be somewhat sharper to facilitate biting into the smooth pin portion to enhance gripping. Here the jaws again are maintained in phase resulting in uniform biting action and gripping of the smooth pin portion.

Thus it is an object of the present invention to provide a jaw assembly or structure for pull tools for setting pull type fasteners of the type having a pin with pull grooves to be gripped by jaws of the jaw assembly and in which the jaws are maintained in phase with each other by maintaining axial and circumferential alignment between the jaws whereby uniform gripping of the pull grooves is provided.

It is an object of the present invention to provide a jaw assembly for pull tools for setting pull type fasteners of the type having a pin with a pull portion to be gripped by jaws of the jaw assembly and in which the jaws are maintained in phase with each other by maintaining axial and circumferential alignment between the jaws whereby uniform gripping of the pull portion is provided.

It is still another object of the present invention to provide a jaw assembly for a pull tool which jaw assembly can be used to install similar fasteners having pull portions with pull grooves of at least two different diameters and/or pull groove pitches.

It is another general object to provide a new and improved jaw assembly for pull tools for setting pull type fasteners of the type having a pin with pull grooves.

It is also a general object to provide a new and improved jaw assembly for pull tools for setting pull type fasteners of the type having a pin with a pull portion which is generally smooth.

It is another object to provide a new and improved nose assembly for pull tools having a jaw structure of a type as noted above and in which the jaws are held open in their deactuated condition to facilitate insertion of a pull portion in clearance and for gripping the pull portion upon actuation to the closed position by the pull tool and release of the pull portion upon the jaws being returned to an open, clearance position with the pull tool being returned to its deactuated condition.

Other objects, features, and advantages of the present invention will become apparent from the subsequent description and the appended claims, taken in conjunction with the accompanying drawings, in which:

DESCRIPTION OF EMBODIMENTS OF THE INVENTION

Figures 1, 2:
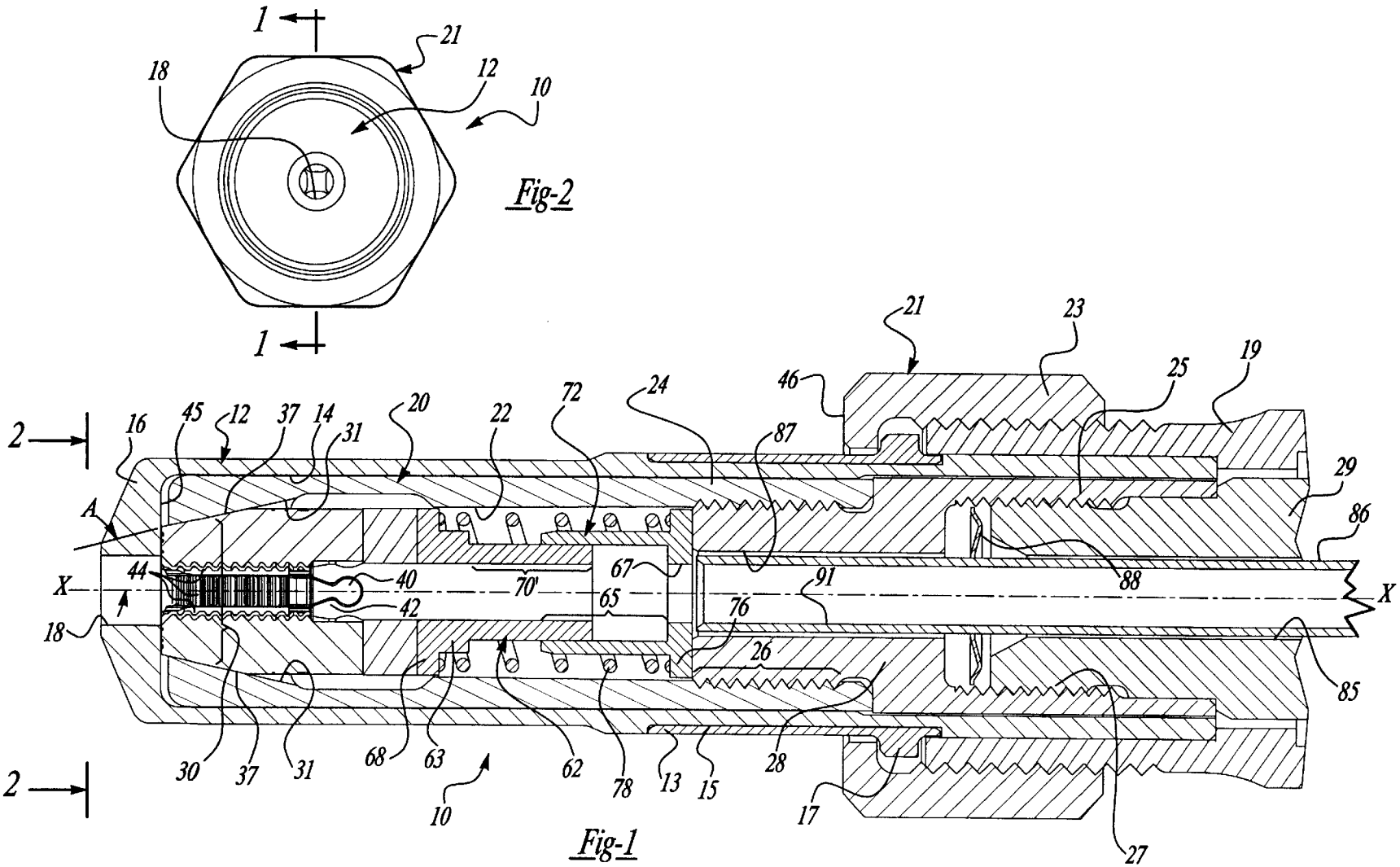
FIG. 1 is a longitudinal sectional view taken generally long the lines 1—1 in FIG. 2 and to enlarged scale of the nose assembly of the present invention for use with a pull type installation tool for installing pull type fasteners.
FIG. 2 is an elevational end view of the nose assembly of FIG. 1 taken in the direction of the Arrow 2 in FIG. 1.

Looking now to FIGS. 1–5 and 5A of the drawings, a nose assembly 10 is shown and includes a generally tubular outer anvil member 12 having an axial bore 14. A longitudinally split locking sleeve 13 is located in an annular groove 15 in the outer surface of anvil member 12. The locking sleeve 13 is provided with a pair of opposed, radially outwardly extending ears or lugs 17 proximate the rearward end for locking engagement with the forward end of the casing 19 of a pull gun member (only partially shown) by means known to the art. The locking sleeve 13 is made of a thin gauge sheet metal which is readily, resiliently expandable to facilitate movement of the sleeve 13 into the groove 15. In this regard the nose assembly 10 is secured to the forward end of the casing 19 by threaded engagement of a hex type, counterbored nut member 21 with a threaded casing end portion 23 with the forward end wall 46 of nut member 21 engaging the ears or lugs 17. The ears or lugs 17 could be provided by a separate ring and groove combination. In some instances the nose assembly 10 is secured to a casing, such as casing 19, by engagement with a generally fixed adapter having a retaining groove accessible through a pair of diametrically opposed slots. Thus the locking sleeve 13 is provided with a series of axial serrations 11 circumferentially disposed at one end to facilitate gripping and manipulation of the sleeve 13 for assembly to the nose assembly 10 to the pull gun member by location of the ears or lugs 17 into the retaining groove by insertion of the ears or lugs 17 through the access slots and then rotation of the sleeve 13 to move the lugs 17 out of alignment with the access slots.

The pull gun member can be of a conventional type capable of applying a relative axial force generally as shown and described in patents such as U.S. Pat. No. 4,587,829, issued May 13, 1986, U.S. Pat. No. 4,597,263, issued Jul. 1, 1986 and U.S. Pat. No. 5,519,926, issued May 28, 1996.

The opposite or outer end of the anvil member 12 is substantially closed by an anvil portion 16 having a front anvil bore 18 located therein. Note that in some constructions a separate anvil portion could be utilized. The anvil bore 18 can have a variety of shapes selected to facilitate different applications. For example in installing pull type swage fasteners the anvil bore 18 would be constructed to have the well known swaging bore configuration. See for example the swaging bore in the '572 Patent, supra.

Slidably disposed within the anvil member 12 is a generally tubular collet member 20 which has an axial bore 22 which is internally threaded at its rearward end portion 24. This rearward portion 24 is threadably engaged with an externally threaded portion 26 of a cylindrical adapter 28 for attachment to a piston rod 29 (partially shown) of the pull gun member with the attachment being by threaded engagement between internally threaded adapter portion 25 and externally threaded piston rod portion 27. The outer end of the collet member 20 has an axially outwardly extending radially inwardly tapering or inclined opening 30 which terminates at its axially inner or rearward end in the larger diameter axial bore 22. This opening 30 is defined by four radially inclined slotted guide tracks 31 which are in quadrature with each other to define a generally, complex cloverleaf shape and having a generally keyhole like configuration.

Figure 3:
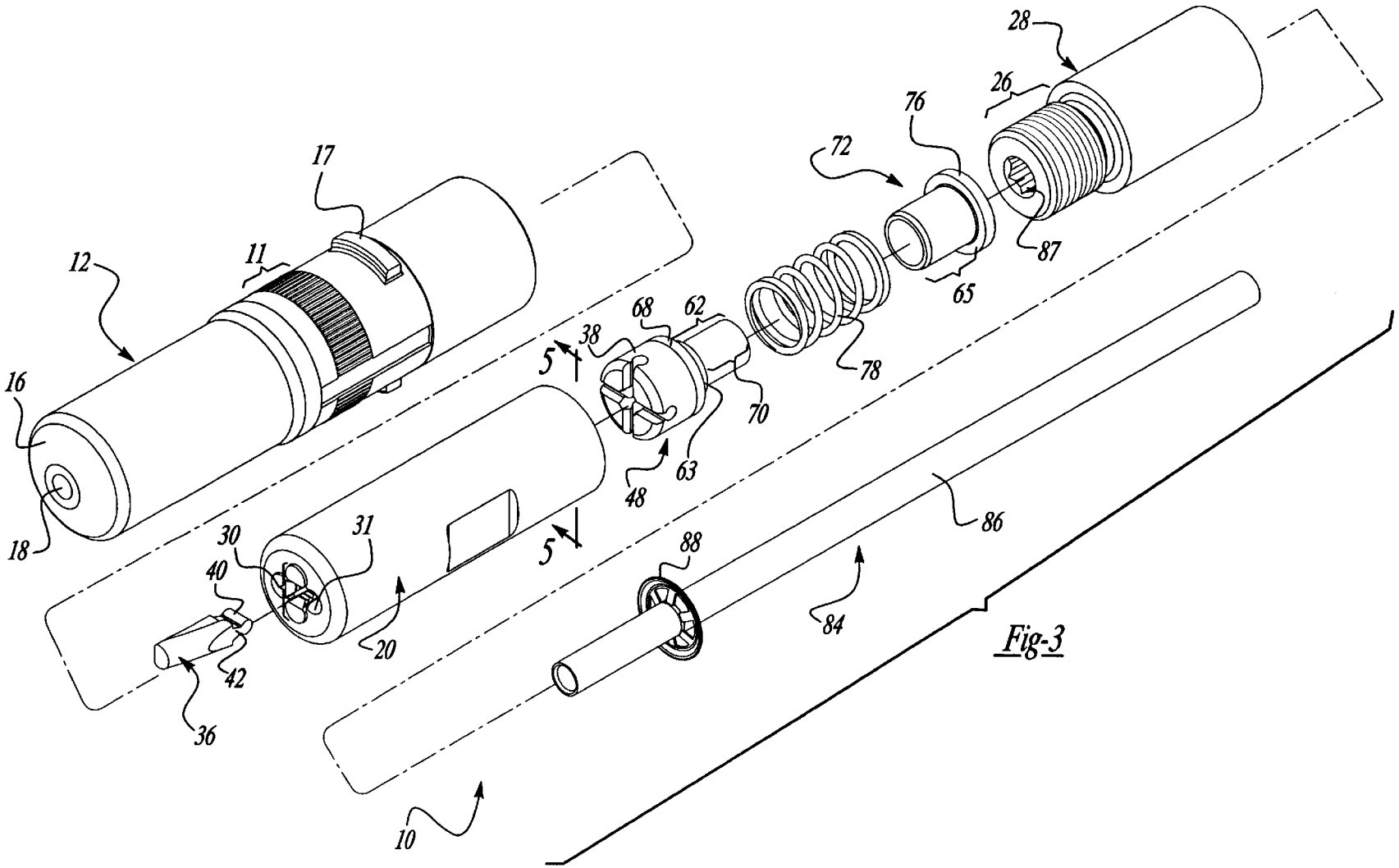
FIG. 3 is an exploded pictorial view of the nose assembly of FIG. 1.
Figure 5:
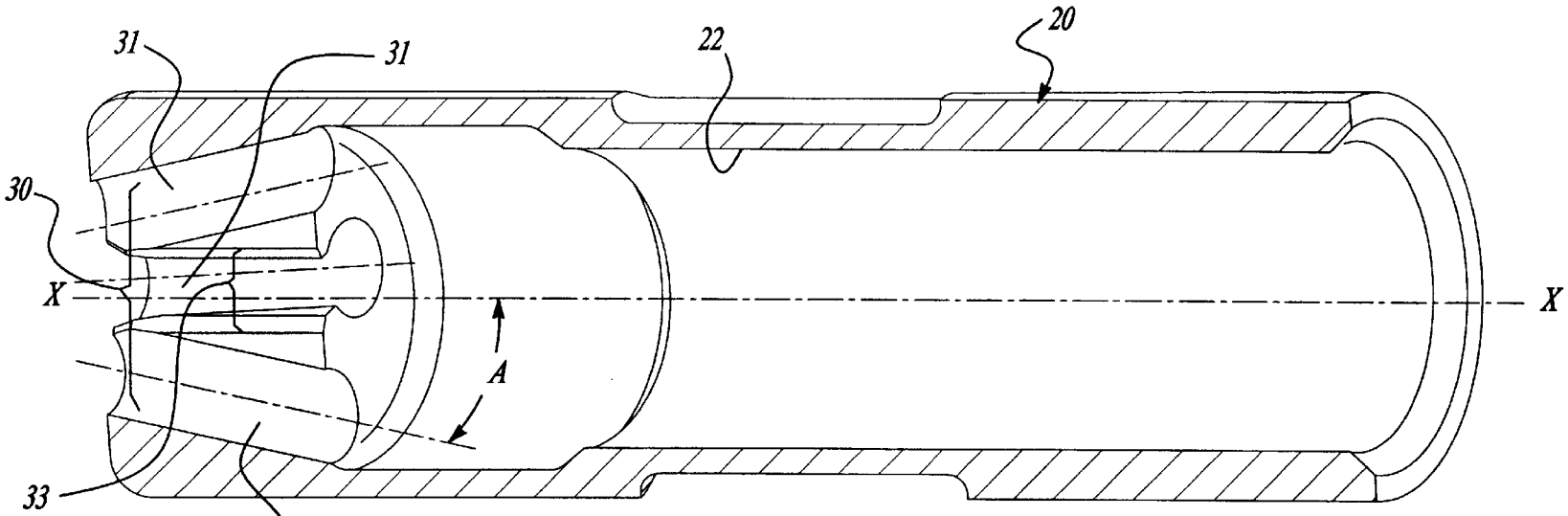
FIG. 5 is a sectional view of the collet member taken generally along the lines 5—5 in FIG. 3 and partially showing the guide slots or tracks for guidingly holding the jaws.

As can be seen in FIGS. 3 and 5, the guide tracks 31 are defined by radially inclined, axially extending bores having a circular cross section which have axially extending openings or slots 33 at their radially inner sides. The circular cross section of the bores extends circumferentially up to the slots 33 for greater than 180° and substantially uniformly for the length of the tracks 31 and, as can be seen in FIG. 5, each of the tracks 31 is constructed to radially contain an associated jaw while permitting it to move axially between radially inner, closed positions to engage a pintail and radially outer, open positions to disengage the pintail.

A jaw assembly 34 is axially slidably disposed within the bore 22 of collet member 20 and comprises a plurality of jaws 36 secured at their rearward or inner ends to the outer end of a generally tubular elastomeric jaw retainer 38 of a jaw follower 48. (See FIGS. 4 and 4A.) The forward or axially outer ends of jaws 36 have front portions with radially outer, axially extending guide shaft sections 37. The surfaces of the guide shaft sections 37 are inclined and have a generally circular shape to fit matingly within the circularly shaped, inclined guide tracks 31 in the collet opening 30. In this regard, it can be seen that the guide shaft sections 37 are generally uniformly cylindrically shaped from their axially outer ends to their planar, axially inner ends 41. Here again the circular contour of the guide shaft sections 37 extends for greater than 180° whereby the jaws 36 will be guidingly supported and retained within the associated guide tracks 31. The radially outer surfaces at the axially inner ends 41 of the guide shaft sections 37 are generally axially planar. The planar inner ends 41 do not extend radially past the adjoining surfaces of the guide shaft sections 37 and in this way provide clearance with surrounding internal surfaces of the collet member 20.

Figures 4, 4A:
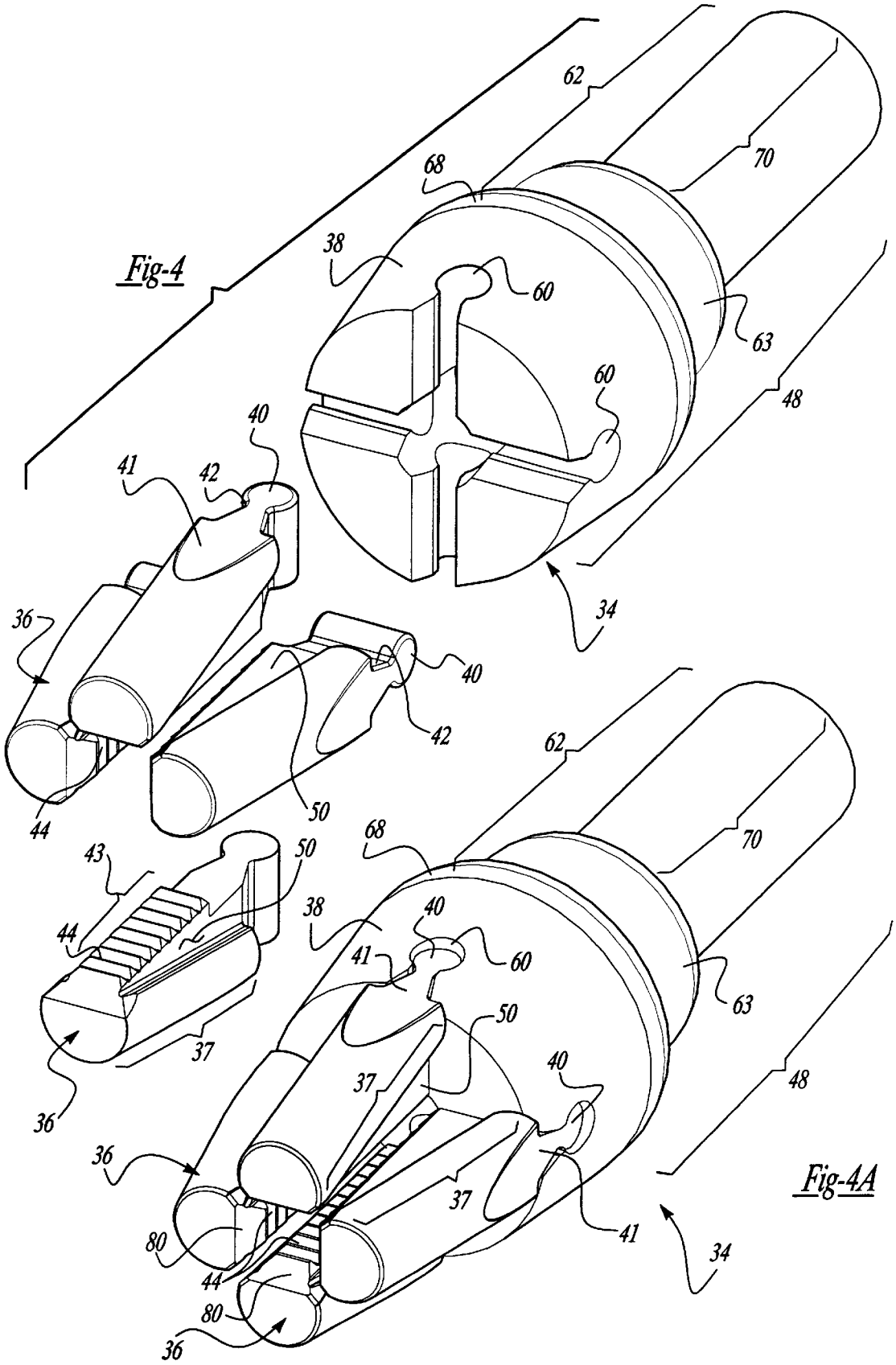
FIG. 4 is an exploded pictorial view of the jaw assembly of FIGS. 1–3 to enlarged scale and with the jaws shown disassembled from the jaw retainer of the jaw follower.
FIG. 4A is a view similar to FIG. 4 showing the jaws assembled to the jaw retainer of the jaw follower.
Figure 5A:
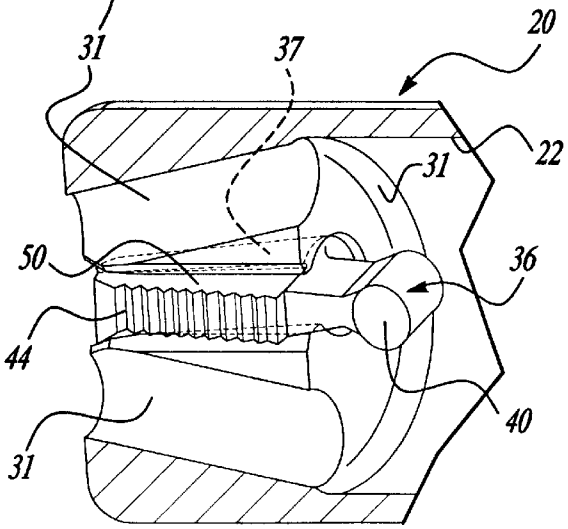
FIG. 5A is a fragmentary view of the front end of the collet member of FIG. 5 and depicting one jaw as located in one of the guide tracks.

The radially inner sections 50 of the jaws 36 opposite the inclined, guide shaft sections 37 are generally wedge shaped with radially inward parallel sides (see FIGS. 4 and 5) terminating in an inner gripping surface 43 which is generally planar and, when assembled, extends generally parallely to the central axis X of the inclined collet opening 30. The inner gripping surfaces 43 are provided with a plurality of gripping teeth 44. As shown in FIGS. 1, 4 and 4A the gripping teeth 44 extend in a generally straight line transversely to the central axis X of the inclined collet opening 30. The gripping teeth 44 can be of conventional, well known constructions adapted to matingly engage pull grooves on the pintail or pull portion of a pin. Alternatively, the radially inner gripping surfaces 43 of the jaws 36 could be arcuately contoured whereby the gripping teeth, such as teeth 44, would extend arcuately to generally match the circular configuration of the pin pull grooves to be gripped. Such structures are well known in the art and have been omitted for purposes of simplicity and brevity. As can be seen in FIGS. 5 and 5A the wedged shaped radially inner sections 50 of the jaws 36 extend radially outwardly through the slot openings 33 in clearance relationship.

Each of the jaws 36 terminates at its axially rearward or inner end in an elongated support rod portion 40 which is joined to the forward end of the jaw 36 by a reduced section, axially tapered neck portion 42 (see FIGS. 1 and 3–5 and 5A). The support rod portion 40 and neck portion 42 extend generally co-extensively radially in a direction transverse to the radially outer guide shaft sections 37 and the gripping teeth 44. The support rod portion 40 has a generally circular contour extending for around 290° to the reduced section neck portion 42.

The elastomeric jaw retainer 38 is a part of the jaw follower 48 which also consists of a metal, spring guide tube 62 having a flange 68 at its axially outer end. The elastomeric jaw retainer 38 is of a resilient construction which can be a flexible urethane or a synthetic or natural rubber combined (polymerized) with one or more co-monomers or co-polymers; the latter can be thermosetting or vulcanized and is bonded to the spring guide tube 62 at the axially outer surface of the flange 68.

The jaws 36, which in one form are four in number, are radially slidably and removably secured to the jaw retainer 38. The mating end of the jaw retainer 38 is provided with a plurality of radially extending, equi-circumferentially spaced pockets 60 which can be molded or otherwise formed therein. Each of the pockets 60 is of a partially closed contour generally complementary to the circular contour of the support rod portion 40 and the reduced section neck portion 42. Thus each of the pockets 60 is open at its axially outer or forward end and adapted to matingly receive the rod portion 40 and neck portion 42. The pockets 60 are of a radial length to axially support and restrain the rod portion 40 and neck portion 42 while permitting radially inward and outward, translational sliding movement. This permits the jaws 36 to slidably move radially inwardly and outwardly when being moved axially inwardly and outwardly while being guidably supported in the inclined tracks 31. The radial, sliding movement of the jaws 36 within the pockets 60 is substantially unrestrained. In one form of the invention, the radial length of the pockets 60 are at least equal to around the radial length of the rod portion 40 and neck portion 42. In this regard these lengths and the close fit of the rod portions 40 and neck portions 42 are selected to be sufficient to adequately restrain axial movement of the jaws 36 relative to the jaw retainer 38.

In this regard, however, the rod portion 40 and neck portion 42 can be located in the pockets 60 with a slight interference fit with the resilience of the elastomeric material of the jaw retainer 38 accommodating this without impeding the generally free radial, translational movement of the jaws 36 within the pockets 60. Such radial movement facilitates radial alignment and mating engagement of the circular outer surfaces of the guide shaft sections 37 with the circular guide tracks 31 during engagement and disengagement of the gripping teeth 44 with the pull grooves of the pintail. At the same time the resilience of the elastomeric jaw retainer 38 permits some minor adjustments to accommodate dimensional tolerances. In addition the elastomeric structure inhibits excessive shock loads on the jaws 36.

Thus the radial alignment and in phase engagement of the jaws 36 is facilitated by the generally free radial movement of the jaws 36 in the pockets 60 while axial movement is restrained. At the same time the matching contour of the pockets 60 will closely contain the support rod portion 40 and connecting neck portion 42 to maintain the jaws 36 in axial alignment. In this regard the pockets 60 are open at least at their radial outer ends whereby insertion or removal of the jaws 36 from the pockets 60 for initial assembly or replacement can be readily accomplished.

As can be seen from FIGS. 1 and 3, the collet member 20 and adapter 28 house and contain the jaw assembly 34. Thus the rearward or back end of the jaw follower 48 includes the spring guide tube 62 which is of a generally cylindrical stepped construction and has an axially outer spring guide portion 63. An elongated reduced diameter tube portion 70 extends axially inwardly or rearwardly from the spring guide portion 63. A cylindrical axially rearward or inner spring guide tube 72 is of a stepped construction and has an inner spring guide portion 65 having an enlarged bore which receives and slidably supports the end of the tube portion 70 of the spring guide tube 62. The enlarged bore of guide portion 65 is connected to a reduced diameter bore 67 for a purpose to be described. The guide portion 65 of the rear or inner spring guide tube 72 is of substantially the same outside diameter as the outer spring guide portion 63. The rear spring guide tube 72 has an enlarged diameter flange 76 and is axially restrained in the axially inner or rearward direction by engagement of the flange 76 with the outer end of the adapter 28. A coil-type bias spring 78 is located between the rearward end of the jaw follower 48 and the forward end of the spring guide tube 72. The outer spring guide portion 63 of the jaw follower 48 is located within the outer end of the bias spring 78 while the inner spring guide portion 65 is located in the opposite or inner end of the bias spring 78 both with a slight clearance and in this manner the bias spring 78 is held in radial alignment.

As assembled the coil spring 78 is resiliently compressed to exert a resilient bias on the jaw follower 48 and hence on the jaw retainer 38 to urge the jaws 36 axially forwardly or outwardly. This will result in the jaws 36 being biased axially forwardly or outwardly into engagement with the inner surface 45 of the anvil portion 16 while the outer, confronting end of the collet member 20 is maintained slightly spaced from that inner surface 45.

At the same time the jaws 36 will be guided radially inwardly by the engaging action of the inclined, arcuate outer surface of the guide shaft sections 37 against the similarly inclined, arcuate guide tracks 31. This will place the jaws 36 in an initially, radially closed position as shown in FIGS. 1 and 4A. In this regard, while the jaws 36 are restrained from radial movement away from the guide tracks 31 and axial movement away from the jaw retainer 38 of follower 48 they can be guidingly moved radially inwardly by the radial sliding action of the rod portion 40 and neck portion 42 within the pockets 60 of the jaw retainer 38 while maintaining the desired axial alignment. At the same time the gripping teeth 44 will be maintained in a plane parallel to the axis X.

In operation to install a pull type fastener, a pintail or pull portion of the pin with pull grooves is moved through the anvil bore 18 and against the jaws 36. The radially inner surfaces 80 at the axially outer end of the jaws 36 are tapered, as is conventional with such gripping jaws, such that together a generally smooth segmented cone is defined to assist insertion and guiding of the pintail or pull portion in between the jaws 36. In this regard, the leading end of the pintail or pull portion is traditionally similarly tapered to facilitate guiding and insertion between the jaws 36. As the pintail or pull portion is moved axially inwardly the jaw assembly 34 with the jaws 36 will be moved axially inwardly or rearwardly against the bias of the coil spring 78. As this occurs the jaws 36 will be guided by engagement with the inclined, arcuate tracks 31 to a radially outward position permitting the pintail or pull portion to be fully moved axially between the jaws 36. When this is completed the jaws 36 will be resiliently urged by the spring 78 to a closed position to matingly grip the pull grooves of the pintail or pull portion. Next the installation pull tool (only partially shown) is actuated to move the collet member 20 axially inwardly or rearwardly relative to the outer anvil member 12 by way of actuation and axial movement of piston rod 29 with the attached adapter 28. In operation the outer anvil member 12 typically will be in engagement with a sleeve, anvil washer or collar of the fastener. Thus the fastener will be subjected to a relative axial force with a pulling force applied to the pin. As this occurs the jaws 36 are urged radially inwardly by the action of the inclined, arcuate tracks 31 against the inclined, arcuate radially outer surfaces of the guide shaft sections 37 to firmly engage and grip the pull grooves of the pintail portion whereby the axial load applied can be readily accepted. As noted, axial alignment of the jaws 36 during their radial inward and outward movement will be maintained by their support in pockets 60. In addition the resilience of the elastomeric jaw retainer 38 will permit the jaws 36 to maintain full mating with circumferential and radial alignment with the mating tracks 31. Thus with the construction as described the jaws 36 and associated jaw teeth 44 will be maintained circumferentially, radially and axially in phase whereby each of the jaws 36 will be in full, equal engagement with the pull grooves.

It should be noted that the angle of inclination A of the tracks 31 and hence of the jaws 36 relative to central axis X is selected to enhance the gripping force of the jaws 36 onto the pull grooves. Thus the magnitude of the axial force applied by the jaw assembly 34 to the pintail of the fastener will have a corresponding multiple effect on the magnitude of gripping force radially applied by the jaws 36 onto the pull grooves. In one form of the embodiment of FIGS. 1–5 the tracks 31 were inclined at an angle A of around 12½° relative to the axis X.

The application of the relative axial pulling force will continue until the fastener is fully installed and, when applicable, the force will be further increased until the pintail or pull portion is severed. The severed pintail or pull portion can then be ejected by passing rearwardly through the nose assembly 10 and through the associated installation tool. Thus in the embodiment of FIGS. 1–5 a pintail tube assembly 84 is shown and includes an elongated pintail tube 86 which extends in a fixed position through a bore 85 in piston rod 29 with its axially outer or forward end located coaxially within a reduced diameter bore portion 87 of a stepped bore through the adapter 28. As can be seen in FIG. 3 the bore portion 87 is generally hexagonally shaped for engagement by a hex-rod wrench to facilitate threaded assembly and disassembly with the collet member 20 via threaded portions 24 and 26. The pintail tube 86 is also axially held in place by a snap ring 88 located on the pintail tube 86 in a space between the piston rod 29 and adapter 28. The pintail tube 86 is located in co-axial alignment and communication with the through bores in jaw follower 48, and cylindrical inner spring guide tube 72 whereby the severed pintail can pass into and through the pintail tube 86. In this regard the reduced diameter bore 67 is substantially equal to the inside diameter 91 of the pintail tube 86 to facilitate movement of the severed pintail into and through the pintail tube 86. While not shown, the pintail tube 86 extends axially rearwardly through the piston rod 29 and associated piston of the installation tool and to an opening at the rearward end of the tool whereby the severed pintail can be discharged at that end. This type of structure is well known in the pull type installation tool art. See for example U.S. Pat. No. 3,157,305, issued Nov. 17, 1964, U.S. Pat. No. 3,792,645, Issued Feb. 19, 1974, U.S. Pat. No. 4,878,372, Issued Nov. 7, 1989, and '719 Patent (supra).

As noted the jaws 36 of the nose assembly 10 of FIGS. 1–5 are generally adapted for use in installing fasteners with a pintail portion with pull grooves with the gripping teeth 44 being shaped to compatibly mate with the pull grooves. It is desirable in some applications to be able to install fasteners with smooth pintail portions which do not have pull grooves. Fasteners of this type are generally shown in the '553 patent, supra. In such instances the gripping teeth, such as teeth 44 are provided to be of a relatively sharp V-shaped construction adapted to bitingly engage the smooth pintail or pull portion of a pin. Alternatively, and as previously noted such V-shaped gripping teeth could extend arcuately to generally match the circular configuration of the smooth pull portion to be gripped. Again such constructions are well known in the art and therefore the details thereof have been omitted for purposes of simplicity and brevity. In this regard it should be understood that jaws with such V-shaped gripping teeth have also been used to install fasteners with pintail portions having pull grooves.

The jaws 36 of the nose assembly 10 of FIGS. 1–5 are generally adapted for use in installing fasteners with a pintail portion with pull grooves that are shaped to be compatibly mated with the gripping teeth 44. It would be desirable in some applications to be able to install fasteners with pintail portions of different diameters with pull grooves of different pitches and/or shapes. Such a construction is shown in the nose assembly of FIGS. 6–8, 8A–B, and 9A–D. In the description of that embodiment, components similar to like components in the embodiment of FIGS. 1–5 are given the same numeral designation with the addition of the letter postscript "a" and unless shown or described otherwise can be considered to be of a substantially similar construction to such like components.

Looking now to FIGS. 6–8, 8A–B and 9A–D of the drawings, a modified nose assembly 10*a* is shown and includes a generally tubular outer anvil member 12*a* having an axial bore 14*a*. A longitudinally split locking sleeve 13*a* is located in an annular groove 15*a* in the outer surface of anvil member 12*a* and is provided with a pair of radially opposed ears or lugs 17*a* for locking engagement with the casing of a pull gun member similarly to that described with the embodiment of FIGS. 1–5. The pull gun member can be of a conventional type also as previously described. The anvil member 12*a*, collet member 20*a* and adapter 28*a* are of substantially the same construction as their similarly numbered counterparts in FIG. 1–5.

The forward end of the outer anvil member 12*a* is substantially closed by an anvil portion 16*a* having a front anvil bore 18*a*. Slidably disposed within the outer anvil member 12*a* is the collet member 20*a* which has an axial bore 22*a* which has a rearward portion 24*a* which is threadably engaged with a threaded portion 26*a* of a cylindrical adapter 28*a* for attachment to a piston rod (not shown) of the pull gun member. The outer or forward end of the collet member 20*a* has a complex, cloverleaf shaped keyhole type opening 30*a*. This opening 30*a* is defined by four inclined guide tracks 31*a* which are in quadrature with each other and are of a generally identical shape.

As with the embodiment of FIGS. 1–5, the guide tracks 31*a* are defined by radially inclined surfaces having a circular cross section which have axially extending slotted openings 33*a* at their radially inner sides. The circular cross section of the tracks 31*a* acts to radially contain the associated jaw while permitting it to move axially between radially inner positions to engage a pintail and radially outer positions to disengage the pintail.

A jaw assembly 34*a* is axially slidably disposed within the bore 22*a* of collet member 20*a* and comprises two pairs of jaws 36*a* and 36*a*' in first and second jaw subassemblies 34*aa* and 34*aa*'. As noted, unlike the four jaws 36 of FIGS. 1–5 which are of identical construction, the first pair of jaws 36*a* while of a similar construction to the second pair of jaws 36*a*' have gripping teeth 44*a* which are different in pitch and hence shape from gripping teeth 44*a*' of jaws 36*a*'. (See FIGS. 9A–D). The axially outer ends of jaws 36*a*, 36*a*' have axially front portions with radially outer, axially extending guide shaft sections 37*a*, 37*a*' which are inclined and have a generally semi-circularly shape to fit matingly within the semi-circularly shaped, inclined guide tracks 31*a*. The radially outer surface at the axially inner ends 41*a*, 41*a*' of the guide shaft sections 37*a*, 37*a*' are generally axially planar for clearance purposes as previously noted.

The surfaces at the radially inner sides of the jaws 36*a*, 36*a*' are provided with the gripping teeth 44*a*, 44*a'*.

Each of the jaws 36*a*, 36*a*' terminates at its axially rearward or inner end in a support rod portion 40*a*, 40*a*' having a generally circular shape and is joined to a reduced section neck portion 42*a*, 42*a*'. The support rod portion 40*a*, 40*a*' and neck portion 42*a*, 42*a*' extend generally co-extensively and in a direction transverse to the gripping teeth 44*a*, 44*a*'. Thus the jaws 36*a*, 36*a*' are of the same basic construction as the jaws 36 in the embodiment shown in FIGS. 1–5. In this regard, however, the wedge shaped radially inner sections 50*a*, 50*a*' with gripping teeth 44*a*, 44*a*' could be of somewhat different radial lengths to better accommodate pull portions of different diameters.

The first pair of jaws 36*a* in first subassembly 34*aa* are adapted to be located in two diametrically opposite tracks 31*a* in collet member 20*a* and are secured at their rearward or inner ends to the outer end of a generally tubular first elastomeric jaw retainer 38*a* which is an integrally formed portion of a first jaw follower 48*a*. The jaw retainer 38*a* is of a resilient construction similar to jaw retainer 38.

The first set of jaws 36*a*, are resiliently but removably secured to the first jaw retainer 38*a*. The forward end of the first jaw retainer 38*a* is provided with a pair of diametrically opposed segments 94 with radially extending pockets 60*a*. The segments 94 are separated by a diametrically extending slot or channel 96 which serves a purpose to be described. Each of the pockets 60*a* is of a contour generally complementary to that of the support rod portion 40*a* and the reduced section neck portion 42*a*. The pockets 60*a* are of sufficient radial length relative to rod portion 40*a* and neck portion 42*a* to permit radially inward and outward movement of the jaws 36*a* while being supported in axial alignment.

As can be seen from FIGS. 6, 8, 8A and 8B, the collet member 20*a* and adapter 28*a* house the jaw assembly 34*a*. The first jaw follower 48*a* is of a stepped construction and has a front spring guide portion 63*a* which is of a reduced diameter cylindrical construction integrally formed with the jaw retainer 38*a*. A rear spring guide tube 72*a* has an enlarged diameter flange 76*a* and is restrained axially rearwardly or inwardly by engagement of the flange 76*a* with the fixed axially outer or forward end of the adapter 28*a*. A first coil-type bias spring 78*a* is located between the axially front spring guide tube portion 63*a* and the axially rear spring guide tube 72*a*. The forward spring guide tube portion 70*a* is located within one end of the first bias spring 78*a* and the rear spring guide portion 65*a* is located in the opposite end of the bias spring 78*a* and in this manner the bias spring 78*a* is held in alignment.

As assembled the first coil spring 78*a* is compressed to exert a resilient bias to urge the first jaw subassembly 34*aa* and first jaw follower 48*a* and first retainer 38*a* axially forwardly or outwardly. This will result in the first pair of jaws 36*a* being biased axially forwardly or outwardly along the tracks 31*a* into engagement with the inner surface 45*a* of the anvil portion 16*a*.

Figure 7:
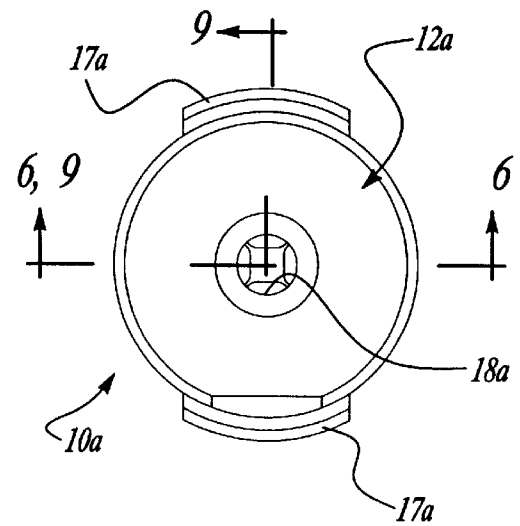
FIG. 7 is an end view of the nose assembly of FIG. 6 taken in the direction of the Arrow 7 in FIG. 6.
Figure 6:
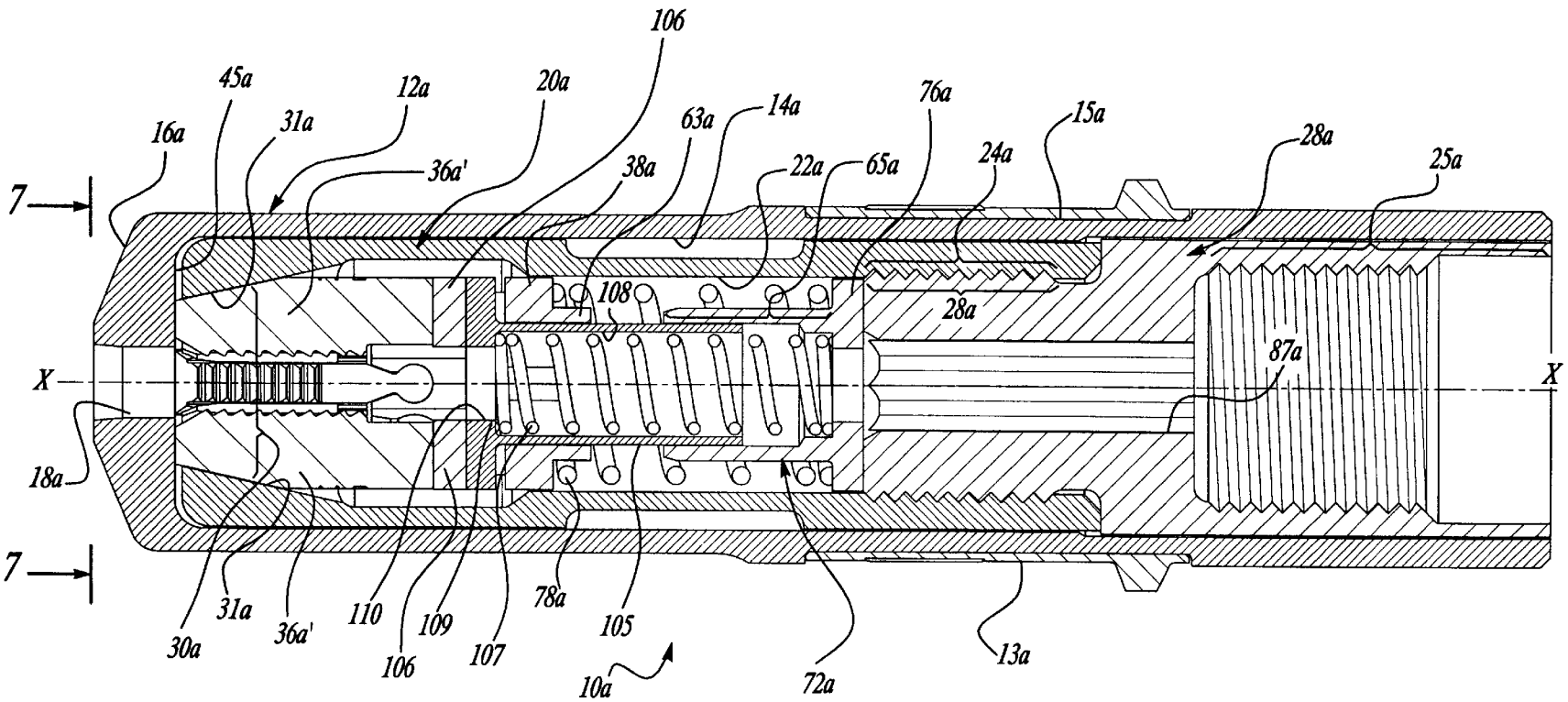
FIG. 6 is a longitudinal sectional view similar to that of FIG. 1 and taken generally along the lines 6—6 in FIG. 7 of a modified nose assembly adapted to install similar fasteners of two different diameters and/or pull groove pitches.
Figure 8:
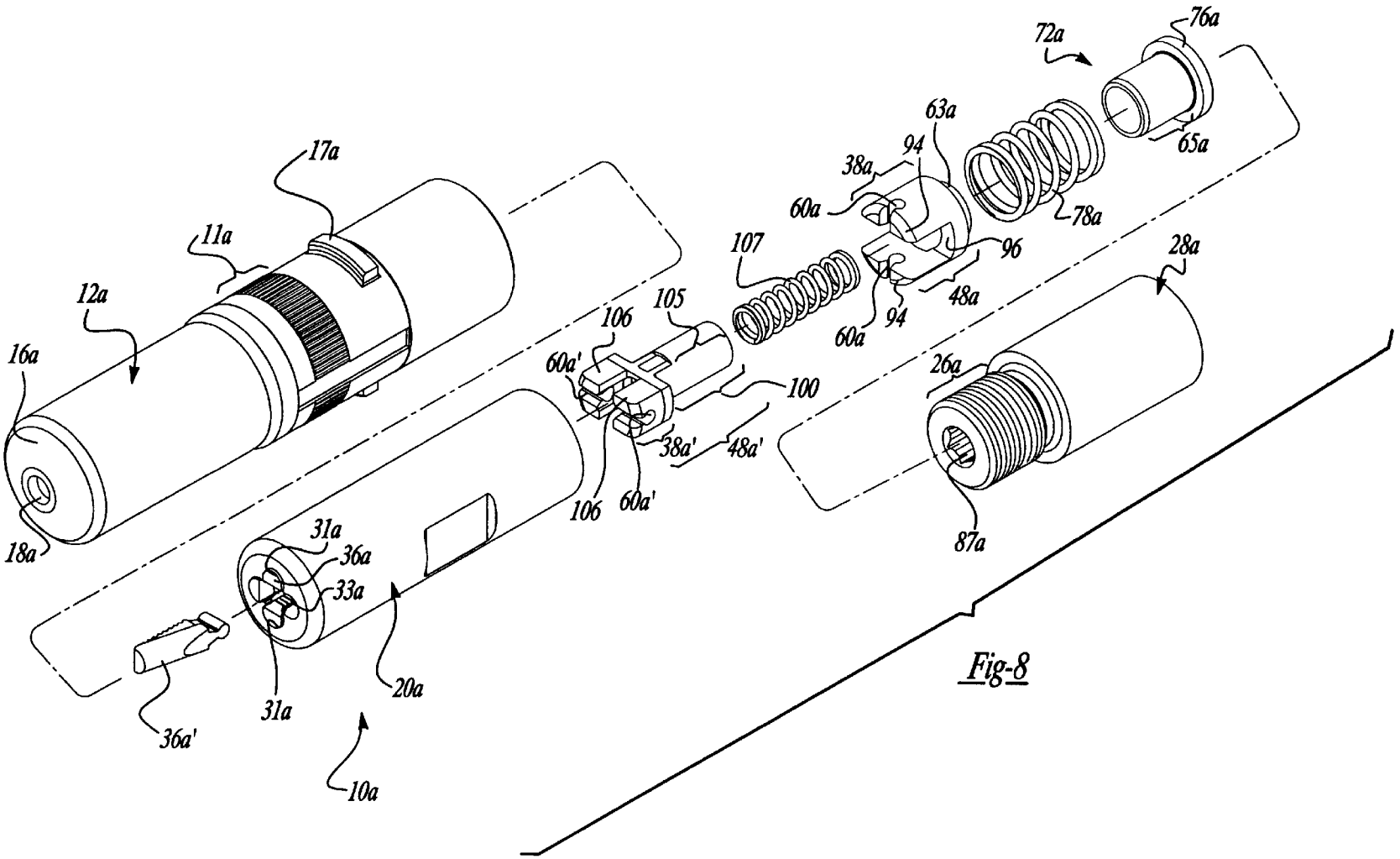
FIG. 8 is an exploded pictorial view of the nose assembly of FIG. 6.
Figure 8A:
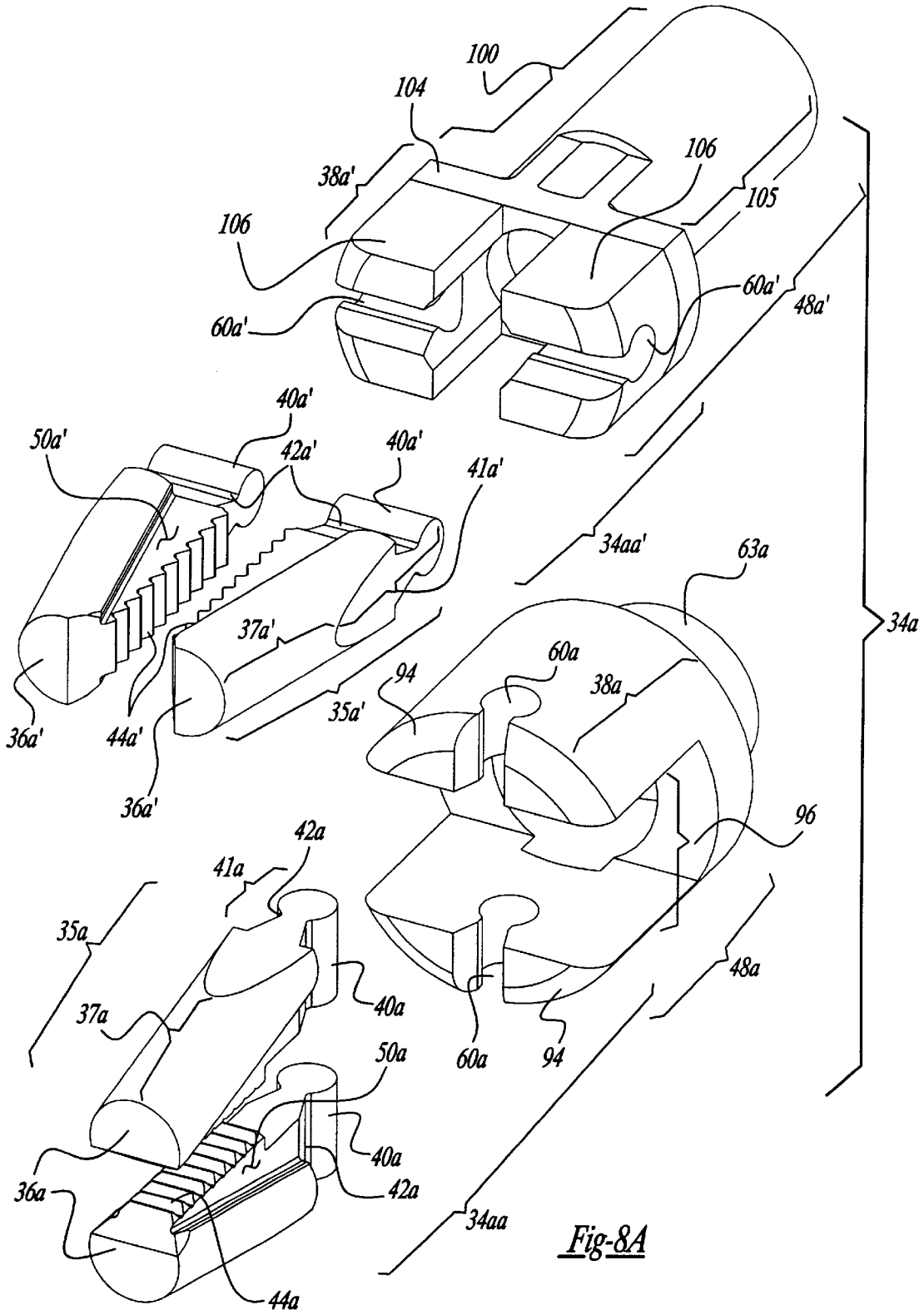
FIG. 8A is an exploded pictorial view of the jaw assembly of FIGS. 6 and 8 with the two interacting jaw subassemblies separated.
Figure 8B:
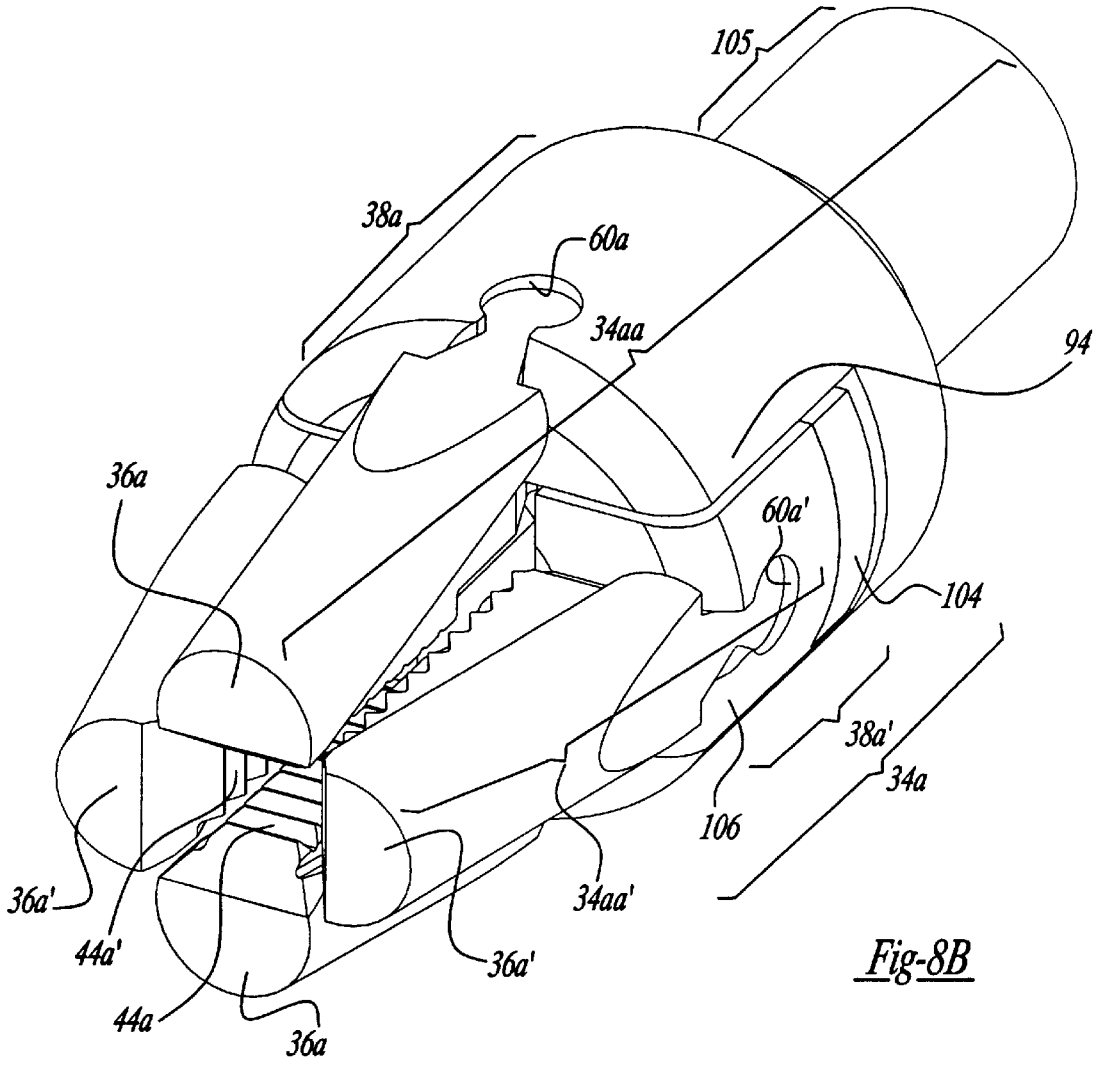
FIG. 8B is a pictorial view showing the jaw assembly of FIG. 8A with the two jaw subassemblies as assembled together.
Figure 9A:
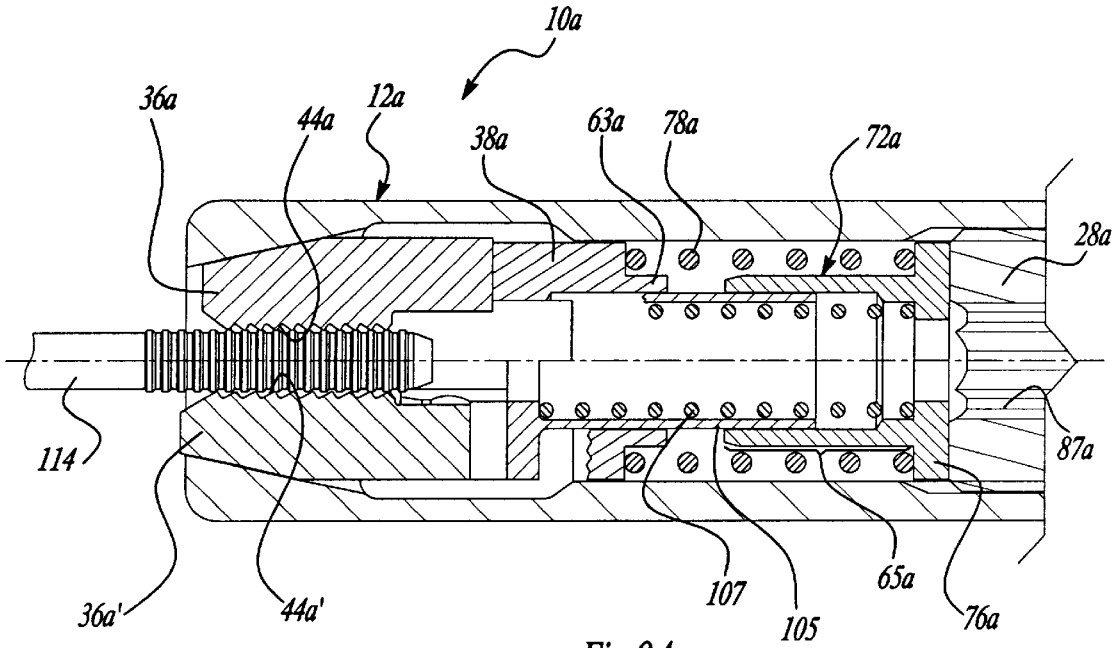
FIGS. 9A–9D are fragmentary sectional views similar to FIG. 6 taken along the lines 9—9 in FIG. 7 of the nose assembly of FIGS. 6–8 in different conditions for installing similar fasteners of two different pull groove pitches and/or diameters with FIGS. 9A and 9B depicting the nose assembly with a fastener with one pull groove pitch and of a small diameter and with FIGS. 9C and 9D depicting the nose assembly with a fastener of a different pull groove pitch and of a larger diameter.
Figure 9B:
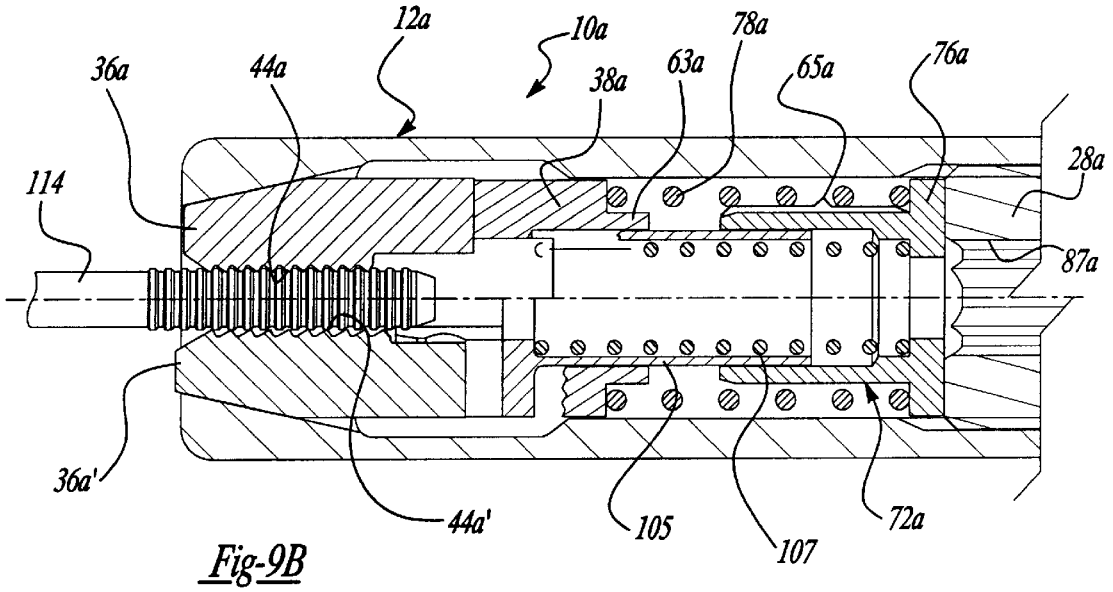
Figure 9C:
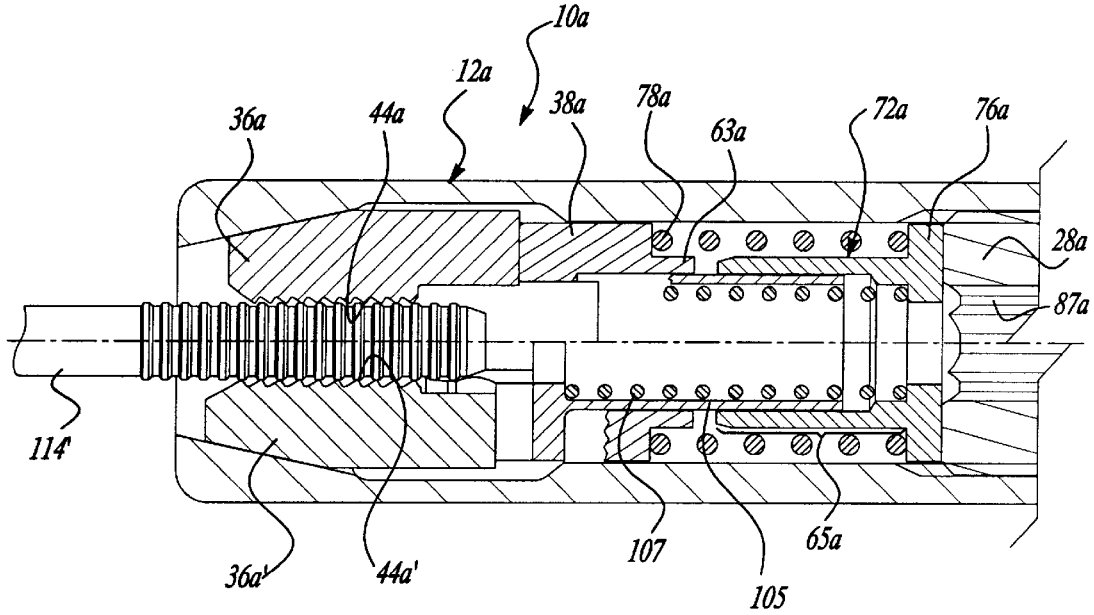
Figure 9D:
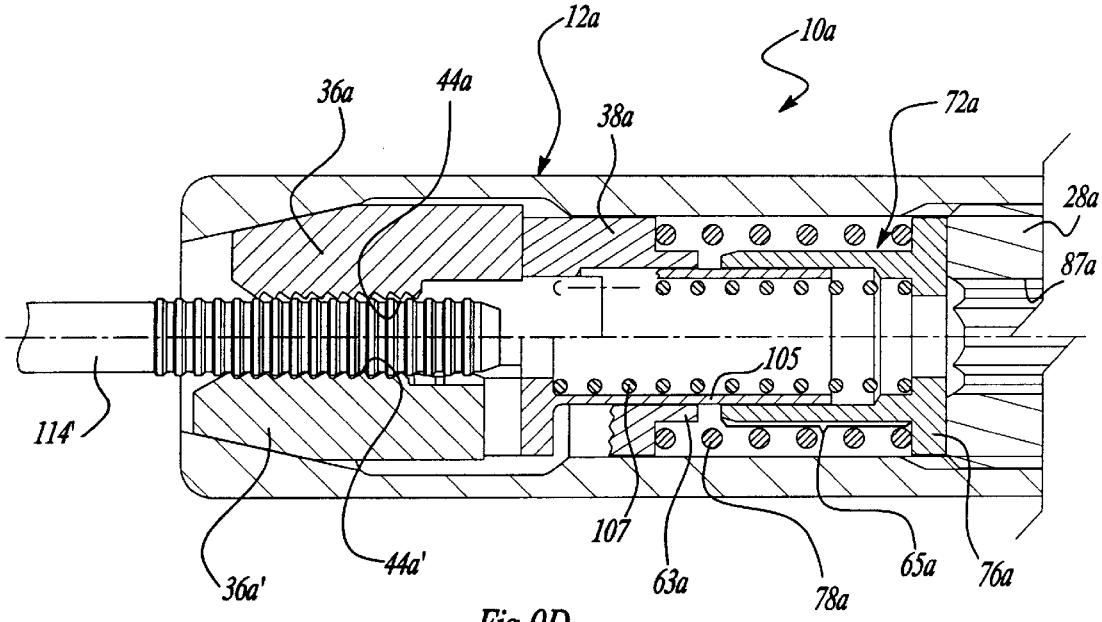

At the same time the jaws 36*a* will be guided radially inwardly by the engagement of the outer surface of the guide shaft sections 37*a* with the similarly contoured guide tracks 31*a*. This will place the jaws 36*a* in an initially, radially closed position as shown in FIGS. 6, 7 and 8B.

As noted, the jaw assembly 34*a* includes a second jaw subassembly 34*aa*' which includes a second set of jaws 36*a*'. These jaws 36*a*' are separately supported and are secured at their rearward or inner ends to the outer or forward end of a second elastomeric jaw retainer 38*a*' of a second jaw follower 48*a*'. As noted the second set of jaws 36*a*' are of a construction similar to the first set of jaws 36*a*.

Thus the surfaces at the radially inner sides of the jaws 36*a*' are also generally planar and are provided with a plurality of gripping teeth 44*a*' similar to teeth 44*a*. However, the pitch and contour of gripping teeth 44*a*' are selected to match the pitch and contour of the pull grooves of a pintail which are different from the pitch and contour of gripping teeth 44*a* of the first set in order to be able to grip the pull grooves in a pintail of larger diameter and larger pitch.

The second elastomeric jaw retainer 38*a*' is part of the second jaw follower 48*a*' and is of a resilient, elastomeric construction similar to that of first jaw retainer 38*a*.

The jaws 36*a*' are also resiliently but removably secured to the second jaw retainer 38*a*' in a pair of pockets 60*a*', each of which is of a contour generally complementary to the contour of the support rod portion 40*a*' and the reduced section neck portion 42*a*'. The pockets 60*a*' are also of a radial length relative to the rod portion 40*a*' and neck portion 42*a*' to permit some radially inward and outward movement of the jaws 36*a*' while being fully supported for axial alignment.

The second jaw subassembly 34*aa*' includes a combination front spring guide 100 of the second jaw follower 48*a*' having a generally T-shaped construction with a diametrically extending rectangular support plate 104 at its outer end. The spring guide 100 is of a metallic construction and has a reduced diameter front spring guide tube portion 105 connected to the opposite or back end of support plate 104 and extends axially rearwardly or inwardly. The second jaw retainer 38*a*' includes the support plate 104 and has two identical, separate elastomeric pocket members 106 which are bonded to diametrically opposite ends of the support plate 104 which is of a metallic construction. When the second jaw subassembly 34*aa*' is assembled to the first jaw sub-assembly 34*aa* the first jaw retainer 38*a* has the support plate 104 and pocket members 106 of the second jaw retainer 38*a*' located within the slot or channel 96. Here the inner spring guide tube portion 105 extends axially inwardly or rearwardly through a mating bore in the first jaw retainer 38*a*. As assembled, the pockets 60*a*' of the second jaw retainer 38*a*' are in quadrature with the pockets 60*a* of the first jaw retainer 38*a*. At the same time, however, the second jaw retainer 38*a*' can slide axially relative to the first jaw retainer 38*a*. In this way, the first pair of jaws 36*a* and the second pair of jaws 36*a*' can be moved separately to provide the desired axial alignment for the pintails of different diameters and/or pull grooves of different pitches to be gripped by each set of jaws. In this regard the second jaw retainer 38*a*' is normally axially spaced from the inner surface of the channel 96 in the first jaw retainer 38*a*. This assists the separate, independent actuation of the jaw sub-assemblies 34*aa* and 34*aa*' and their associated jaws 36*a* and 36*a*'.

Here, however, the second jaws 36*a*' are located in the other two diametrically opposed tracks 31*a* which are in quadrature with the tracks 31*a* for jaws 36*a*.

As previously noted, the first jaw retainer 38*a* is biased axially outwardly or forwardly by the first bias spring 78*a*. The second jaw retainer 38*a*' is separately biased forwardly or outwardly by a second coil bias spring 107. The second coil spring 107 is of a smaller diameter and is located in an enlarged bore portion 108 extending through the inner spring guide tube portion 105. The outer or forward end of the second or inner bias spring 107 is held in fixed engagement with a radially inwardly extending wall portion 109 in inner spring guide tube portion 105. The wall portion 109 has a reduced diameter bore 110 through the support plate 104. The rear spring guide tube 72*a* has a spring guide portion 65*a* which is of substantially the same outside diameter as the outer or forward spring guide portion 63*a*. The inner or rearward end of the spring guide tube portion 105 is slidably supported in the bore in spring guide tube portion 65*a*. The rear spring guide tube 72*a* has an enlarged diameter flange 76*a* and is axially restrained in the axially inner or rearward direction by engagement of the flange 76*a* with the outer end of the adapter 28*a*.

In this way the pintail, when severed, can readily pass through the outer spring guide tube portion 63*a* and outer spring 78*a* and inner spring guide tube portion 105 and inner spring 107 for rearward ejection upon completion of the installation.

In the sectional sequence drawings of FIGS. 9A–D, the lower half of the section has been rotated 90° such that the working relationship between jaw assemblies 34*a* and 34*a*' can be more readily seen. (See FIG. 7).

Looking now to FIGS. 9A–D the first pair of jaws 36*a* have their radially inner sides and teeth 44*a* aligned with a pitch for matching the pitch of the smaller diameter pin and pintail 114. (See FIGS. 9A, B). Conversely, the second pair of jaws 36*a*' have their radially inner sides and teeth 44*a*' shaped with a larger pitch to match the pitch of a larger diameter pin and pintail 114'. (See FIGS. 9C, D). In their deactivated positions, however, the first set of jaws 36*a* will define an opening of substantially the same diameter as the second set of jaws 36*a*'. Thus when the smaller diameter pintail 114 is inserted into the jaw assemblies 34*a*, 34*a*', the pull grooves will be in minimal engagement with the gripping teeth 44*a*' of the second set of jaws 36*a*'. This is a result of the pitch or axial spacing and shape of the gripping teeth 44*a* and 44*a*' being different to match the different pitches of the pull grooves in the small diameter pintail 114 and pull grooves on the large diameter pintail 114', respectively. Their mismatch will create an out of phase condition whereby substantial gripping of the wrong pintail will be inhibited. In this regard the first pair of jaws 36*a* will be moved axially inwardly or rearwardly and radially outwardly readily by the bias of the first bias spring 78*a* as the smaller pintail 114 is initially inserted. As this occurs, the gripping teeth 44*a* will be able to ratchet over the pull grooves until engaged to assure the desired mating engagement (see FIGS. 9A and B).

Contrariwise, however, when a larger diameter pintail 114' is to be inserted into the jaw assembly 34*a*, 34*a*' the first set of jaws 36*a* will be readily moved against the outer bias spring 78*a* axially inwardly or rearwardly and radially outwardly for a generally non-engaged position with the larger diameter pull grooves of different pitch. This will move the first jaw retainer 38*a* rearwardly and out of engagement with the second jaw retainer 38*a*'. (See FIGS. 9C and D). However, the second jaw retainer 38*a*' will still be urged axially outwardly to bias the second pair of jaws 36*a*' axially outwardly and radially inwardly against the inclined tracks 31*a*. This will place the second pair of jaws 36*a*' in a position whereby upon insertion of the larger diameter pintail 114' the gripping teeth 44*a*' will ratchet over the pull grooves upon initial insertion and later move radially inwardly to matingly engage the pull grooves.

In this manner, the nose assembly 10*a* can be utilized to install fasteners having different pintail groove pitches as well as different diameters. It can be seen that the one set of the jaws 36*a*, 36*a*' that are not matingly engaged with the related pull grooves can still bite somewhat into the flanks or crests of the pull grooves to exert an additional limited magnitude of pulling force with little stress on the associated jaw teeth 44*a*, 44*a*'.

It can be seen from the preceding that a jaw assembly of less than four jaws can be effective to install pull type fasteners, i.e. at least two diametrically opposed jaws.

Figure 10:
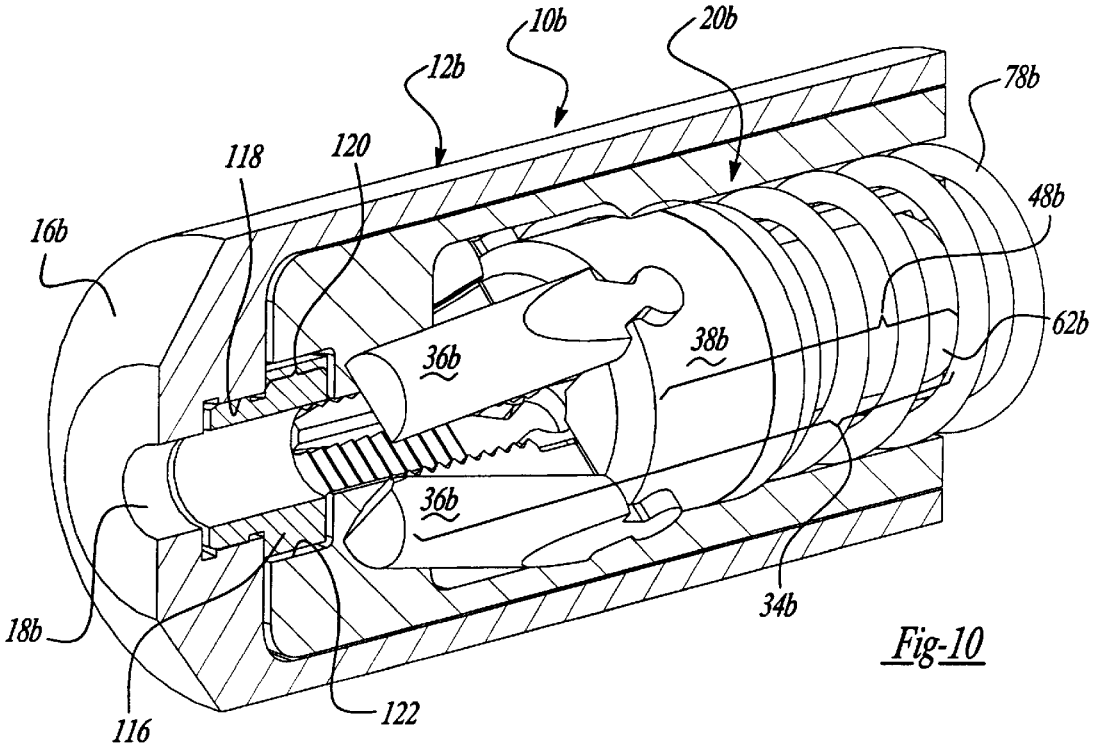
FIG. 10 is a longitudinal, pictorial fragmentary sectional view similar to that of FIG. 1 depicting a modified form of the nose assembly of FIGS. 1–5 in a deactuated condition.
Figure 11:
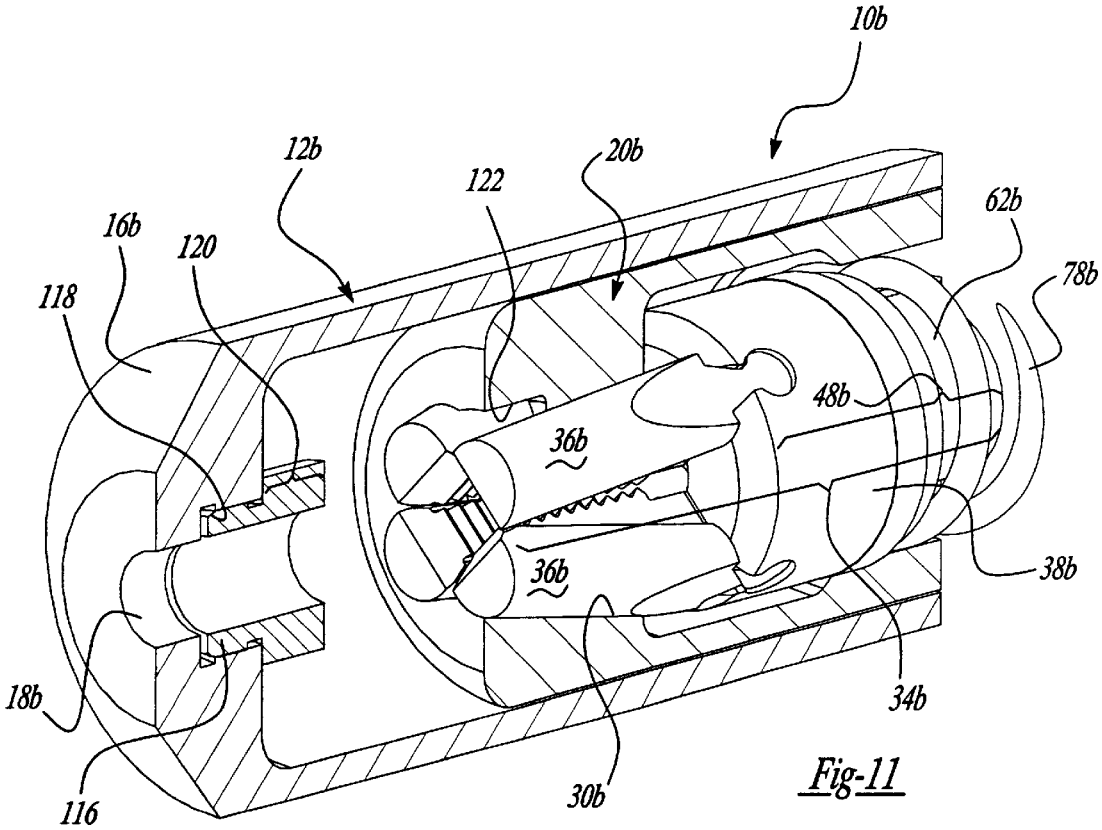
FIG. 11 is a view of the embodiment of FIG. 10 showing the nose assembly in an actuated condition.

In some applications it is desirable that the gripping jaw members be maintained in a fully open, non-gripping position when in the deactuated condition. This facilitates initial insertion of the pintail or pull portion of the pin in clearance with the jaw teeth and also at the completion of installation the jaw members will be returned to their fully opened position completely releasing the severed pintail. With some installation tools this facilitates rearward ejection of the severed pintail portion. A modified form of the invention and embodiment of FIGS. 1–5 having the noted structure is shown in FIGS. 10 and 11. In the description of the embodiment of FIGS. 10 and 11 components similar to like components in the embodiment of FIGS. 1–5 have been given the same numeral designation with the addition of the letter postscript "b". As will be seen the embodiment of FIGS. 10 and 11 is substantially identical with that of FIGS. 1–5 with the addition of a structure for holding the jaw members open when in the deactuated condition. Thus the modified nose assembly is only partially shown and unless otherwise described, will be considered to be of a structure substantially the same as that of FIGS. 1–5; in this regard the similarly numbered components can be considered to be of substantially the same construction and therefore a repetition of such details has been omitted for purposes of brevity and simplicity.

Looking now to FIGS. 10 and 11 of the drawings, the modified nose assembly 10*b* is shown and includes a generally tubular outer anvil member 12*b* having an axial bore 14*b*. The opposite or forward end of the outer anvil member 12*b* is substantially closed by an anvil portion 16*b* having a front anvil bore 18*b*.

Slidably disposed within the outer anvil member 12*b* is a generally tubular collet member 20*b*. The forward end of the collet member 20*b* has a complex cloverleaf keyhole like opening 30*b*. This opening 30*b* has four inclined guide tracks 31*b*.

A jaw assembly 34*b* is axially slidably disposed within the bore 22*b* of collet member 20*b* and comprises four jaws 36*b*. The jaws 36*b* are secured at their inner ends to the elastomeric jaw retainer 38*b* of jaw follower 48*b*.

A coil spring 78*b* is adapted to exert a resilient bias on the jaw follower 48*b* to urge the jaw assembly 34*b* axially forwardly or outwardly. This will result in the jaws 36*b* being biased axially forwardly or outwardly towards the anvil portion 16*b*. Here a bushing 116 having a stepped construction is located in a reduced diameter bore portion 118 on the inside of the anvil bore 18*b*. An enlarged diameter bushing portion 120 then extends axially inwardly or rearwardly from the anvil bore 18*b*.

Thus, now when the jaw assembly 34*b* is in its deactuated position, as shown in FIG. 10, the jaws 36*b* will be moved into engagement with the enlarged diameter bushing portion 120. At the same time the forward end of the collet member 20*b* will be moved past the forward end of the jaws 36*b*. In this regard the opening 30*b* is provided with a counterbore 122 of a diameter and depth to permit the forward end of the collet member 20*b* to move freely over the enlarged bushing portion 120. Thus the jaws 36*b* will be held axially rearwardly and radially outwardly in an open position when deactuated. This open position will be sufficient to accept a pintail or pull portion in a clearance condition.

Now upon actuation, the collet member 20*b* will be moved axially rearwardly and with the guide tracks 31*b* now moving the jaws 36*b* to their closed positions to facilitate gripping of a pintail or pull portion of the pin of a fastener to be installed (see FIG. 11). As noted upon completion of the installation the collet member 20*b* will be moved axially outwardly or forwardly to its original deactuated position as shown in FIG. 10. This will move the jaws 36*b* into engagement with the enlarged bushing portion 120 resulting in the jaws 36*b* being moved radially outwardly to their open position releasing the pintail or pull portion thereby facilitating its ejection. As noted except for the different construction described above, the nose assembly 10*b* can be substantially identical to the nose assembly 10 of FIGS. 1–5. In this regard it should be noted that the jaw opener structure including the bushing 116 could be readily adapted for use with the embodiment of FIGS. 6–9.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed:

1. Apparatus for applying a fastener to workpieces which fastener includes a pin member having a shank and a plurality of grooves therein and with the fastener being secured to the workpieces in response to a relative axial force applied to the fastener including an axial pulling force applied to the pin member, said apparatus comprising a generally cylindrical anvil member having a forward portion thereof for operatively engaging the fastener and including a front anvil opening adapted to receive the pin shank, a generally cylindrical collet member slidably located within said anvil member and having an axial bore terminating at its forward end in an opening in axial alignment with said front anvil opening, said opening having a plurality of circumferentially spaced guide tracks, each of said guide tracks being defined by radially inclined, axially extending bores having a cross section defining a generally arcuate shape with axially extending slots at their radially inner sides, said arcuate cross section extending for greater than 180° whereby said guide tracks are partially closed, a jaw assembly comprising a plurality of gripping jaws and a jaw follower member, said gripping jaws being of a rigid construction and having a radially outer seating section having an arcuate contour adapted to generally matably fit within said arcuate shape of said guide tracks of said collet, each of said gripping jaws having a radially inner surface with a plurality of jaw teeth thereon adapted to grip the grooves of the pin member, said jaw follower disposed in said axial bore of said collet member and having retaining means for securing said gripping jaws to a forward end of said jaw follower for radially inward and outward translational movement between open and closed positions as said jaws are moved axially and radially angularly in said guide tracks, each of said jaws having an end portion including a radially extending rod portion connected to a reduced section neck portion, said retaining means of said jaw follower comprising a plurality of radially extending pockets at said forward end and adapted to receive said rod portions, said pockets being partially closed at said forward end to overengage said rod portions and said neck portions, said pockets having a radial length adapted to engage said rod portions to permit said rod portions to slidably move radially inwardly and outwardly in translation while being axially restrained, said jaw follower thereby locating said jaws in axial alignment with each other with said guide tracks maintaining said jaws radially and circumferentially in phase with said teeth on said jaws being maintained in phase with each other whereby misalignment of said jaw teeth of operatively associated ones of said jaws is substantially precluded.

2. The apparatus of claim 1 with said pockets gripping said jaws for selective radial movement in translation and being radially opened whereby manual insertion and removal of said jaws is facilitated.

3. The apparatus of claim 1 including spring means operatively connected to said jaw follower assembly for resiliently urging said jaw follower assembly with said retaining means axially outwardly to urge said gripping jaws to a closed position.

4. The apparatus of claim 3 with said forward portion of said anvil member including a jaw engagement structure adapted to engage said jaws as urged to their axially outward position and to maintain said gripping jaws in a radially open condition to facilitate insertion and removal of the pin shank.

5. Apparatus for applying a fastener to workpieces which fastener includes a pin member having a shank and a plurality of grooves therein and with the fastener being secured to the workpieces in response to a relative axial force applied to the fastener including an axial pulling force applied to the pin member, said apparatus comprising a generally cylindrically shaped anvil member having a forward portion thereof for engaging the fastener and including a front anvil opening adapted to receive the pin shank, a generally cylindrically shaped collet member slidably located within said anvil member and having an axially extending collet bore terminating at its forward end in an opening in axial alignment with said front anvil opening, said opening having a plurality of circumferentially spaced guide tracks, each of said guide tracks being defined by radially inclined, axially extending bores having a cross section defining a preselected shape with axially extending slots at their radially inner sides whereby said guide tracks are partially closed, a jaw assembly including a plurality of gripping jaws and a support member, said gripping jaws being of a rigid construction and defining a conically tapered outer surface adapted to generally matably fit said preselected shape within said guide tracks of said collet member and each having an inner surface with a plurality of jaw teeth thereon adapted to grip the grooves of the pin member, said support member disposed in said collet bore including a jaw follower including retaining means constructed of an elastomeric material for securing said gripping jaws to a forward end, said jaw follower with said retaining means and said gripping jaws being movable within said collet bore from a first position in which said jaws are engaged with said guide tracks and are radially closed thereby and a second position in which said jaws are in a radially open condition, each of said jaws having a reduced section end portion, said retaining means comprising a plurality of pockets adapted to removably, grippingly receive said reduced section end portion for radial, sliding movement in translation as said gripping jaws are moved between the first and second positions whereby said jaw teeth of operatively associated ones of said jaws are maintained axially in phase.

6. Apparatus for applying a fastener to workpieces which fastener includes a pin member having a shank and a plurality of grooves therein and with the fastener being secured to the workpieces in response to a relative axial force applied to the fastener including an axial pulling force applied to the pin member, said apparatus comprising a generally cylindrically shaped anvil member having a forward portion thereof for engaging the fastener and including a front anvil opening adapted to receive the pin shank, a generally cylindrical collet member slidably located within said anvil member and having an axial bore terminating at its forward end in a tapered opening in axial alignment with said front anvil opening, said opening having a plurality of circumferentially spaced guide tracks, each of said guide tracks being defined by radially inclined, axially extending bores having a cross section defining a preselected shape with axially extending slots at their radially inner sides whereby said guide tracks are partially closed, a jaw assembly including a plurality of gripping jaws and a support member, said gripping jaws being of a rigid construction and defining a conically tapered outer surface adapted to generally matably fit said preselected shape within said guide tracks of said collet member and each having an inner surface with a plurality of jaw teeth thereon adapted to grip the grooves of the pin member, said support member disposed in said collet bore and including a jaw follower including retaining means for securing said gripping jaws, said gripping jaws being individually removably secured to a forward end of said retaining means, each of said jaws having a reduced section end portion, said retaining means having a plurality of pockets integrally formed at said forward end and adapted to grippingly receive said reduced section end portion, said jaw follower with said retaining means and said jaws being movable within said guide tracks from a first position in which said jaws are engaged with said tapered opening and are radially closed thereby and a second position in which said jaws are in a radially open condition, said jaws as secured in said pockets of said retaining means being movable radially inwardly and outwardly in translation as said jaws are moved between closed and open conditions.

7. The apparatus of claim 6 with said jaws being selectively movable into and out of said pockets whereby manual insertion and removal of said jaws is facilitated.

8. The apparatus of claim 6 with said pockets extending radially and having a depth relative to the length of said jaw end portions to permit radially inward and outward movement of said gripping jaws in translation by sliding movement and to retain said jaws axially to locate said jaws in axial alignment with each other whereby said jaw teeth on said jaws are maintained in phase with each other.

9. Apparatus for applying a fastener to workpieces which fastener includes a pin member having a shank with a pull portion thereon and with the fastener being secured to the workpieces in response to a relative axial force applied to the fastener including an axial pulling force applied to the pin member, said apparatus comprising a generally tubular anvil member having a forward portion thereof for operatively engaging the fastener and including a front anvil opening adapted to receive the pin shank, a generally tubular collet member slidably located within said anvil member and having an axial bore terminating at its forward end in an opening in axial alignment with said front anvil opening, said opening having a plurality of circumferentially spaced guide tracks, each of said guide tracks being defined by radially inclined, axially extending bores having a cross section defining a generally arcuate shape with axially extending slots at their radially inner sides with said guide tracks being partially closed, a jaw assembly comprising a plurality of gripping jaws and a jaw follower member, said gripping jaws being of a rigid construction and having a radially outer guide shaft section having an arcuate contour adapted to generally matably fit within said arcuate shape of said guide tracks of said collet, each of said gripping jaws having a radially inner surface with a plurality of jaw teeth thereon adapted to grip the pull portion of the pin member, said jaw follower disposed in said axial bore of said collet member and having retaining means for securing said gripping jaws to a forward end of said jaw follower for radially inward and outward translational movement between open and closed positions as said jaws are moved axially and radially angularly in said guide tracks, each of said jaws having an end portion, said retaining means of said jaw follower comprising a plurality of pockets at said forward end and adapted to receive said end portions, said pockets having a contour adapted to engage said end portions to permit said end portions and thus said jaws to move radially inwardly and outwardly in translation while being axially restrained, said jaw follower thereby locating said jaws in axial alignment with each other with said guide tracks maintaining said jaws radially and circumferentially in phase whereby said teeth on said jaws are maintained in phase with each other whereby misalignment of said jaw teeth of operatively associated ones of said jaws is substantially precluded, said pockets having openings whereby manual insertion and removal of said jaws is facilitated.

10. Apparatus for applying a fastener to workpieces which fastener includes a pin member having a shank with a pull portion thereon and with the fastener being secured to the workpieces in response to a relative axial force applied to the fastener including an axial pulling force applied to the pin member, said apparatus comprising an anvil member having a forward portion thereof for engaging the fastener and including a front anvil opening adapted to receive the pin shank, a collet member slidably located within said anvil member and having an axial bore terminating at its forward end in an angulated, tapered opening in axial alignment with said front anvil opening, said opening having a plurality of circumferentially spaced guide tracks, each of said guide tracks being defined by radially inclined, axially extending bores having a cross section defining a preselected shape with axially extending slots at their radially inner sides whereby said guide tracks are partially closed, a jaw assembly including a plurality of gripping jaws and a jaw follower, said jaws being of a rigid construction and defining a generally angulated tapered outer surface adapted to generally matably fit within said guide tracks of said collet member and each having an inner surface with a plurality of jaw teeth thereon adapted to grip the pull portion of the pin member, said jaw follower disposed in said collet member and having retaining means for securing said gripping jaws to a forward end of said jaw follower for radially inward and outward translational movement between open and closed positions as said jaws are moved axially and angularly in said guide tracks, each of said jaws having an end portion, said retaining means of said jaw follower adapted to receive said end portions of said jaws and having a contour adapted to engage said end portions to permit said end portions and thus said jaws to move radially inwardly and outwardly in translation while being axially restrained whereby axial misalignment of said jaw teeth of operatively associated one of said jaws is substantially precluded.

11. The apparatus of claim 10 with said retaining means comprising a plurality of pockets at said forward end for grippingly receiving said end portions of said jaws with said jaws being slidably movable radially inwardly and outwardly in translation and being selectively radially movable into and out of said pockets whereby the separate manual insertion and removal of each of said jaws is facilitated.

12. Apparatus for applying a fastener to workpieces which fastener includes a pin member having a shank with a pull portion thereon and with the fastener being secured to the workpieces in response to a relative axial force applied to the fastener including an axial pulling force applied to the pin member, said apparatus comprising a generally cylindrical anvil member having a forward portion thereof for operatively engaging the fastener and including a front anvil opening adapted to receive the pin shank, a generally cylindrical collet member slidably located within said anvil member and having an axial bore terminating at its forward end in an opening in axial alignment with said front anvil opening, said tapered opening having a plurality of circumferentially spaced guide tracks, each of said guide tracks being defined by radially inclined, axially extending bores having a cross section defining a generally circumferential contour being open at their radially inner sides by axially extending slots at their radially inner sides, said cross section extending for greater than 180° up to said slots whereby said guide tracks are partially circumferentially closed, a jaw assembly comprising a plurality of gripping jaws and a jaw follower member, said gripping jaws being of a rigid construction and having a radially outer guide shaft section having a contour adapted to generally matably fit within said enclosed contour of said guide tracks of said collet member, each of said gripping jaws having a radially inner surface with a plurality of jaw teeth thereon adapted to grip the pull portion of the pin member, said jaw follower disposed in said axial bore of said collet member and having retaining means for securing said gripping jaws to a forward end of said jaw follower for radially inward and outward translational movement between open and closed positions as said jaws are moved axially and radially angularly in said guide tracks, each of said jaws having an end portion including a radially extending end portion, said retaining means of said jaw follower comprising a plurality of radially extending pockets at said forward end and adapted to receive said end portions, said pockets being partially closed at said axially forward end to overengage said rod portions, said pockets having a radial length adapted to grippingly engage said end portions to permit said end portions to slidably move radially inwardly and outwardly in translation while being axially restrained, said jaw follower thereby locating said jaws in axial alignment with each other with said guide tracks maintaining said jaws radially and circumferentially in phase whereby said teeth on said jaws are maintained in phase with each other whereby misalignment of said jaw teeth of operatively associated ones of said jaws is substantially precluded.

13. The apparatus of claim 12 with said pockets gripping said jaws for selective radial movement in translation and being radially opened whereby manual insertion and removal of said jaws is facilitated.

14. Apparatus for applying fasteners to workpieces which fasteners include pin members each having a shank and a plurality of pull grooves therein and with the fastener being secured to the workpieces in response to a relative axial force applied to the fastener including an axial pulling force applied to the pin members, the fasteners including a first fastener having a first pin member with a shank having pull grooves of a first pitch and a second fastener having a second pin member with a shank having pull grooves of a second pitch said apparatus comprising a generally cylindrical anvil member having a forward portion thereof for operatively engaging the fastener and including a front anvil opening adapted to receive the pin shank, a generally cylindrical collet member slidably located within said anvil member and having an axial bore terminating at its forward end in an opening in axial alignment with said front anvil opening, said opening having a plurality of circumferentially spaced guide tracks located in quadrature with each other, each of said guide tracks being defined by radially inclined, axially extending bores having a cross section defining a generally arcuate shape with axially extending slots at their radially inner sides, said arcuate cross section extending for greater than 180° whereby said guide tracks are partially closed, a first jaw assembly comprising a first pair of gripping jaws and a first jaw follower member and a second jaw assembly comprising a second pair of gripping jaws and a second jaw follower member, said first and second pairs of gripping jaws being of a rigid construction and having a radially outer guide shaft section having an arcuate contour adapted to generally matably fit within said arcuate shape of said guide tracks of said collet member, each of said first and second gripping jaws having a radially inner surface with a plurality of jaw teeth thereon, said jaw teeth of said first gripping jaws having a first pitch adapted to matingly engage the pull grooves of the first pitch of the first pin member and said jaw teeth of said second gripping jaws having a second pitch adapted to matingly engage the pull grooves of the second pitch of the second pin member, said first and second jaw followers disposed in said axial bore of said collet member, said first jaw follower having first retaining means for securing said first pair of gripping jaws in diametrically opposed locations at a forward end of said first jaw follower for location in one diametrically opposed set of said guide tracks, said second jaw follower having second retaining means for securing said second pair of gripping jaws in diametrically opposed locations at a forward end of said second jaw follower for location in the other diametrically opposed set of said guide tracks in quadrature with the other set of said guide tracks, said first and second pairs of gripping jaws being secured by said first and second retaining means for radially inward and outward translational movement between open and closed positions as said first and second pair of jaws are moved simultaneously axially and radially angularly in the respective ones of said guide tracks, each of said jaws having an end portion including a radially extending rod portion connected to a reduced section neck portion, said first and second retaining means of said first and second jaw followers comprising a plurality of radially extending pockets at said forward ends and adapted to receive said rod portions, said pockets being partially closed at said forward end to overengage said rod portions and said neck portions, said pockets having a radial length adapted to engage said rod portions to permit said rod portions to slidably move radially inwardly and outwardly in translation while being axially restrained, said first and second jaw followers thereby locating the associated jaws of said first and second pairs of jaws in axial alignment with each other with said guide tracks maintaining said associated jaws of said first and second pairs of jaws radially and circumferentially in phase whereby said teeth on the associated ones of said jaws are maintained in phase with each other whereby misalignment of said jaw teeth of operatively associated ones of said jaws is substantially precluded.

15. The apparatus of claim 14 with said first and second jaw followers being operatively connected with said first pair of jaws and said second pair of jaws being circumferentially held in quadrature with each other.

16. The apparatus of claim 15 with said second jaw follower being supported in said forward end of said first jaw follower with said first and second jaw followers being axially movable both separately and together.

17. The apparatus of claim 15 with said pockets gripping said first and second pairs of jaws for selective radial movement in translation and being radially opened whereby manual insertion and removal of said jaws is facilitated.

18. The apparatus of claim 15 including first spring means operatively connected to said first jaw follower assembly for resiliently urging said first jaw follower assembly axially outwardly to urge said first pair of gripping jaws to a closed position and a second spring means operatively connected to said second jaw follower assembly for resiliently urging said second jaw follower assembly axially outwardly to urge said second pair of gripping jaws to a closed position.

19. The apparatus of claim 18 with said forward portion of said anvil member including a jaw engagement structure adapted to engage said first and second pairs of jaws as urged to their axially outward position and to maintain said first and second gripping jaws in an open condition to facilitate insertion and removal of the pin shank.

20. The apparatus of claim 14 with said first and second jaw followers being operatively connected with said first pair of jaws and said second pair of jaws being circumferentially held in quadrature with each other, said second jaw follower being supported in said forward end of said first jaw follower with said first and second jaw followers being axially movable both separately and together, said pockets gripping said first and second pairs of jaws for selective radial movement in translation and being radially opened whereby manual insertion and removal of said jaws is facilitated, including first spring means operatively connected to said first jaw follower assembly for resiliently urging said first jaw follower assembly axially outwardly to urge said first pair of gripping jaws to a closed position and a second spring means operatively connected to said second jaw follower assembly for resiliently urging said second jaw follower assembly axially outwardly to urge said second pair of gripping jaws to a closed position.

21. The apparatus of claim 20 with said forward portion of said anvil member including a jaw engagement structure adapted to engage said first and second pairs of jaws as urged to their axially outward positions and to maintain said first and second gripping jaws in an open condition to facilitate insertion and removal of the pin shank.

22. The apparatus of claim 14 with said first and second jaw followers being operatively connected with said first pair of jaws and said second pair of jaws being circumferentially held in quadrature with each other, said second jaw follower being supported in said forward end of said first jaw follower with said first and second jaw followers being axially movable both separately and together, said pockets gripping said first and second pairs of jaws for selective radial movement in translation and being radially opened whereby manual insertion and removal of said jaws is facilitated, including first spring means operatively connected to said first jaw follower assembly for resiliently urging said first jaw follower assembly axially outwardly to urge said first pair of gripping jaws to a closed position and a second spring means operatively connected to said second jaw follower assembly for resiliently urging said second jaw follower assembly axially outwardly to urge said second pair of gripping jaws to a closed position, said first jaw follower having a diametrically extending slot in said first forward end being in quadrature with said pockets in said first forward end, said second jaw follower being supported in said slot with said pockets in said second forward end being in quadrature with said pockets in said first forward end, said second jaw follower being axially movable in said slot relative to said first jaw follower while being restrained from circumferential movement relative to said first jaw follower.

23. Apparatus for applying fasteners to workpieces which fasteners include pin members each having a shank and a plurality of pull grooves therein and with the fastener being secured to the workpieces in response to a relative axial force applied to the fastener including an axial pulling force applied to the pin member, the fasteners including a first fastener having a first pin member with a shank having pull grooves of a first pitch and a second fastener having a second pin member with a shank having pull grooves of a second pitch said apparatus comprising a generally cylindrical anvil member having a forward portion thereof for operatively engaging the fastener and including a front anvil opening adapted to receive the pin shank, a generally cylindrical collet member slidably located within said anvil member and having an axial bore terminating at its forward end in an opening in axial alignment with said front anvil opening, said opening having a plurality of circumferentially spaced guide tracks, each of said guide tracks being defined by radially inclined, axially extending bores having a cross section defining a preselected shape with axially extending slots at their radially inner sides whereby said guide tracks are partially closed, a first jaw assembly comprising a first pair of gripping jaws and a first jaw follower member and a second jaw assembly comprising a second pair of gripping jaws and a second jaw follower member, said first and second pairs of gripping jaws being of a rigid construction and having a conically tapered radially outer seating section adapted to generally matably fit within said guide tracks in said opening of said collet member, each of said first and second gripping jaws having a radially inner surface with a plurality of jaw teeth thereon, said jaw teeth of said first gripping jaws having a first pitch adapted to matingly engage the pull grooves of the first pitch of the first pin member and said jaw teeth of said second gripping jaws having a second pitch adapted to matingly engage the pull grooves of the second pitch of the second pin member, said first and second jaw followers disposed in said axial bore of said collet member, said first jaw follower having first retaining means for securing said first pair of gripping jaws in diametrically opposed locations at a forward end of said first jaw follower for location in said guide tracks of said collet member, said second jaw follower having second retaining means for securing said second pair of gripping jaws in diametrically opposed locations at a forward end of said second jaw follower for location in said guide tracks of said collet member in quadrature with said first pair of gripping jaws, said first and second pairs of gripping jaws being secured by said first and second retaining means for radially inward and outward translational movement between open and closed positions as said first and second pair of jaws are moved simultaneously axially and radially angularly in said guide tracks, each of said jaws having a reduced section end portion, said first and second retaining means of said first and second jaw followers comprising a plurality of pockets adapted to grippingly receive said reduced section end portions to permit said reduced section end portions to slidably move radially inwardly and outwardly in translation while being axially restrained, said first and second jaw followers thereby locating the associated jaws of said first and second pairs of jaws in axial alignment with each other whereby said teeth on the associated ones of said jaws are maintained in phase with each other whereby misalignment of said jaw teeth of operatively associated ones of said jaws is substantially precluded.

24. The apparatus of claim 23 with said first and second retaining means being constructed of an elastomeric material for resiliently securing said jaws in said pockets, said pockets gripping said jaws for selective radial movement in translation and being radially opened whereby manual insertion and removal of said jaws is facilitated.

25. In apparatus for applying a fastener to workpieces which fastener includes a pin member having a shank and a plurality of grooves therein and with the fastener being secured to the workpieces in response to a relative axial force applied to the fastener including an axial pulling force applied to the pin member, said apparatus comprising a generally cylindrical anvil member having a forward portion thereof for operatively engaging the fastener and including a front anvil opening adapted to receive the pin shank, a generally cylindrical collet member slidably located within said anvil member and having an axial bore terminating at its forward end in an opening in axial alignment with said front anvil opening, said opening having a plurality of circumferentially spaced guide tracks, each of said guide tracks being defined by radially inclined, axially extending bores having a cross section defining a generally arcuate shape with axially extending slots at their radially inner sides, said arcuate cross section extending for greater than 180° whereby said guide tracks are partially closed, a jaw assembly comprising a plurality of gripping jaws and a jaw follower member, said jaw follower disposed in said axial bore of said collet member and having retaining means for securing said gripping jaws to a forward end of said jaw follower for radially inward and outward translational movement between open and closed positions as said jaws are moved axially and radially angularly in said guide tracks, said retaining means of said jaw follower comprising a plurality of radially extending pockets at said forward end and adapted to receive said end portions, said pockets being partially closed at said forward end to overengage said end portions, said pockets having a radial length adapted to engage said end portions to permit said end portions to slidably move radially inwardly and outwardly in translation while being axially restrained, the combination including said gripping jaws being of a rigid construction and having a radially outer guide shaft section having an arcuate contour adapted to generally matably fit within said arcuate shape of said guide tracks of said collet member, each of said gripping jaws having a radially inner surface with a plurality of jaw teeth thereon adapted to grip the grooves of the pin member, said end portion of each of said jaws having a radially extending rod portion connected to a reduced section neck portion with said rod portion and neck portion being located in gripping engagement in said pockets, said jaw follower thereby locating said jaws in axial alignment with each other with said guide tracks maintaining said jaws radially and circumferentially in phase whereby said teeth on said jaws are maintained in phase with each other whereby misalignment of said jaw teeth of operatively associated ones of said jaws is substantially precluded.

* * * * *